US010545453B2

(12) United States Patent
Iwasaki et al.

(10) Patent No.: US 10,545,453 B2
(45) Date of Patent: Jan. 28, 2020

(54) PROCESS CARTRIDGE AND ELECTROPHOTOGRAPHIC APPARATUS

(71) Applicant: CANON KABUSHIKI KAISHA, Tokyo (JP)

(72) Inventors: Shuhei Iwasaki, Yokohama (JP); Kazunori Noguchi, Suntou-gun (JP); Harunobu Ogaki, Suntou-gun (JP); Tatsuya Yamaai, Yokohama (JP); Daisuke Miura, Tokyo (JP); Akira Sakakibara, Susono (JP); Takumi Furukawa, Susono (JP); Yuya Tomomizu, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/196,106

(22) Filed: Nov. 20, 2018

(65) Prior Publication Data

US 2019/0163118 A1 May 30, 2019

(30) Foreign Application Priority Data

Nov. 24, 2017 (JP) ..... 2017-226332

(51) Int. Cl.
*G03G 5/00* (2006.01)
*G03G 21/18* (2006.01)
(Continued)

(52) U.S. Cl.
CPC ..... *G03G 21/1814* (2013.01); *G03G 5/056* (2013.01); *G03G 5/0564* (2013.01);
(Continued)

(58) Field of Classification Search
CPC ..... G03G 5/14708; G03G 5/14752; G03G 5/14756; G03G 5/14795
(Continued)

(56) References Cited

U.S. PATENT DOCUMENTS 6,991,881 B2 1/2006 Ogaki et al.
6,994,941 B2 2/2006 Tanaka et al.
(Continued)

FOREIGN PATENT DOCUMENTS

JP 2013-205674 10/2013

OTHER PUBLICATIONS

U.S. Appl. No. 16/198,008, Tatsuya Yamai, filed Nov. 21, 2018.
U.S. Appl. No. 16/198,105, Daisuke Miura, filed Nov. 21, 2018.

*Primary Examiner* — Mark A Chapman
(74) *Attorney, Agent, or Firm* — Venable LLP

(57) ABSTRACT

Provided are a process cartridge and an electrophotographic apparatus each suppressed in fluctuation in charging potential at the time of its long-term use. The process cartridge includes: an electrophotographic photosensitive member having a surface layer containing a resin and a charge-transporting substance; and a charging member configured to charge the electrophotographic photosensitive member, wherein an average of Martens hardnesses of the surface layer of the electrophotographic photosensitive member measured at a pushing force of 7 mN is 245 N/mm$^2$ or more, and wherein in a core defined by three-dimensional surface texture standards (ISO 25178-2:2012) of the surface of the charging member, an average of Martens hardnesses measured at a pushing force of 0.04 mN is 2 N/mm$^2$ or more and 20 N/mm$^2$ or less, and an average of adhesivenesses measured with a scanning probe microscope in a field of view of 2-micrometer square is 70 mV or less.

10 Claims, 2 Drawing Sheets

(51) Int. Cl.
*G03G 5/05* (2006.01)
*G03G 5/147* (2006.01)

(52) U.S. Cl.
CPC ..... *G03G 5/14708* (2013.01); *G03G 5/14752* (2013.01); *G03G 5/14756* (2013.01); *G03G 5/14795* (2013.01)

(58) Field of Classification Search
USPC ..... 430/66
See application file for complete search history.

(56) References Cited

U.S. PATENT DOCUMENTS 7,001,699 B2 2/2006 Tanaka et al.
7,045,261 B2 5/2006 Tanaka et al.
7,413,840 B1 8/2008 Ogaki et al.
7,551,878 B2 6/2009 Ogaki et al.
7,553,594 B2 6/2009 Ogaki et al.
7,622,238 B2 11/2009 Uematsu et al.
7,629,102 B2 12/2009 Ochi et al.
7,645,547 B2 1/2010 Okuda et al.
7,655,370 B2 2/2010 Kitamura et al.
7,693,457 B2 4/2010 Kuruma et al.
7,704,657 B2 4/2010 Uesugi et al.
7,718,331 B2 5/2010 Uematsu et al.
7,749,667 B2 7/2010 Kawahara et al.
7,875,410 B2 1/2011 Ogaki et al.
7,927,774 B2 4/2011 Ogaki et al.
7,931,848 B2 4/2011 Ochi et al.
7,962,068 B2 6/2011 Kuroda et al.
8,445,113 B2 5/2013 Furukawa et al.
8,457,528 B2 6/2013 Ochi et al.
8,469,867 B2 6/2013 Kuroda et al.
8,501,325 B2 8/2013 Tomomizu et al.
8,503,911 B2 8/2013 Suzumura et al.
8,526,857 B2 9/2013 Tomomizu et al.
8,622,881 B1 1/2014 Harada et al.
8,669,027 B2 3/2014 Anezaki et al.
8,685,601 B2 4/2014 Nose et al.
8,753,789 B2 6/2014 Ogaki et al.
8,755,714 B2 6/2014 Nagamine et al.
8,815,479 B2 8/2014 Shida et al.
8,846,281 B2 9/2014 Okuda et al.
8,865,380 B2 10/2014 Noguchi et al.
8,921,020 B2 12/2014 Murai et al.
8,980,508 B2 3/2015 Okuda et al.
8,980,509 B2 3/2015 Noguchi et al.
8,991,053 B2 3/2015 Watanabe et al.
9,034,545 B2 5/2015 Maruyama et al.
9,114,565 B2 8/2015 Kawai et al.
9,188,888 B2 11/2015 Okuda et al.
9,207,550 B2 12/2015 Okuda et al.
9,235,144 B2 1/2016 Yamamoto et al.
9,274,442 B2 3/2016 Sato et al.
9,280,071 B2 3/2016 Maruyama et al.
9,280,072 B2 3/2016 Ogaki et al.
9,282,615 B2 3/2016 Yamagishi et al.
9,304,414 B2 4/2016 Miura et al.
9,304,416 B2 4/2016 Noguchi et al.
9,341,964 B2 5/2016 Ogaki et al.
9,360,833 B2 6/2016 Terada et al.
9,372,428 B2 6/2016 Kuroda et al.
9,436,107 B2 9/2016 Murakami et al.
9,507,283 B2 11/2016 Maruyama et al.
9,575,422 B2 2/2017 Okuda et al.
9,599,917 B2 3/2017 Okuda et al.
9,651,879 B2 5/2017 Maruyama et al.
9,726,992 B2 8/2017 Sakuma et al.
9,791,792 B2 10/2017 Miyauchi et al.
9,851,646 B2 12/2017 Tomono et al.
9,904,199 B2 2/2018 Terada et al.
9,910,379 B2 3/2018 Furukawa et al.
10,146,149 B2 12/2018 Watanabe et al.
2012/0076535 A1 3/2012 Nagamine et al.
2013/0004206 A1 1/2013 Kuroda et al.
2013/0034369 A1 2/2013 Masu et al.
2013/0064571 A1 3/2013 Kodama et al.
2014/0154618 A1 6/2014 Maruyama et al.
2014/0212800 A1 7/2014 Miura et al.
2015/0185630 A1 7/2015 Ito et al.
2017/0060008 A1 3/2017 Okuda et al.
2018/0059558 A1 3/2018 Ito et al.
2018/0101107 A1 4/2018 Tomomizu et al.
2018/0120727 A1 5/2018 Masu et al.

PROCESS CARTRIDGE AND ELECTROPHOTOGRAPHIC APPARATUS

BACKGROUND OF THE INVENTION

Field of the Invention

The present invention relates to a process cartridge and an electrophotographic apparatus.

Description of the Related Art

In an electrophotographic process, demands for an improvement in print speed and mass printing have been growing in recent years, and hence the lengthening of the lifetime of a process cartridge has been required. In order to meet the requirement, a method involving forming the surface layer of an electrophotographic photosensitive member from a resin having an excellent mechanical strength to impart a high surface hardness to the layer so that its abrasion resistance may be improved has been investigated.

When the hardness of the surface layer of the electrophotographic photosensitive member is improved by the above-mentioned method, toner strongly adheres to the surface of the electrophotographic photosensitive member during its use process. Thus, the following problem has sometimes been observed. As the number of printed sheets increases, the toner migrates from the surface of the electrophotographic photosensitive member to the surface of a charging member to accumulate, thereby causing a fluctuation in charging potential of the photosensitive member.

In Japanese Patent Application Laid-Open No. 2013-205674, in order that the adhesion of toner to the surface of a charging member may be suppressed, there is a proposal of an approach involving smoothening the shape of the surface of the charging member to reduce friction between the charging member and an electrophotographic photosensitive member.

However, even when the charging member described in Japanese Patent Application Laid-Open No. 2013-205674 described above is used, in the case where the hardness of the surface layer of the electrophotographic photosensitive member is high, the adhesion of the toner to the surface of the charging member cannot be completely suppressed, and hence a suppressing effect on a fluctuation in charging potential of the photosensitive member has not been sufficient.

SUMMARY OF THE INVENTION

Therefore, an object of the present invention is to provide a process cartridge and an electrophotographic apparatus each being suppressed in fluctuation in charging potential at the time of its long-term use even in the case where the hardness of the surface layer of an electrophotographic photosensitive member is high.

The object is achieved by the present invention described below. That is, according to one embodiment of the present invention, there is provided a process cartridge including: an electrophotographic photosensitive member having a surface layer containing a resin and a charge-transporting substance; and a charging member configured to charge the electrophotographic photosensitive member, wherein an average of Martens hardnesses of the surface layer of the electrophotographic photosensitive member measured at a pushing force of 7 mN is 245 N/mm$^2$ or more, and wherein in a core defined by three-dimensional surface texture standards (ISO 25178-2:2012) of a surface of the charging member, an average of Martens hardnesses measured at a pushing force of 0.04 mN is 2 N/mm$^2$ or more and 20 N/mm$^2$ or less, and an average of adhesivenesses measured with a scanning probe microscope in a field of view of 2-micrometer square is 70 mV or less.

According to another embodiment of the present invention, there is provided an electrophotographic apparatus including the process cartridge.

According to the present invention, even in the case where the hardness of the surface layer of an electrophotographic photosensitive member is high, strong adhesion of toner to the surface layer of the electrophotographic photosensitive member is suppressed, and at the same time, the adhesion of the toner to the surface of a charging member can be suppressed. Thus, the process cartridge and the electrophotographic apparatus each suppressed in fluctuation in charging potential at the time of its long-term use can be provided.

Further features of the present invention will become apparent from the following description of exemplary embodiments with reference to the attached drawings.

DESCRIPTION OF THE EMBODIMENTS

Figure 1:
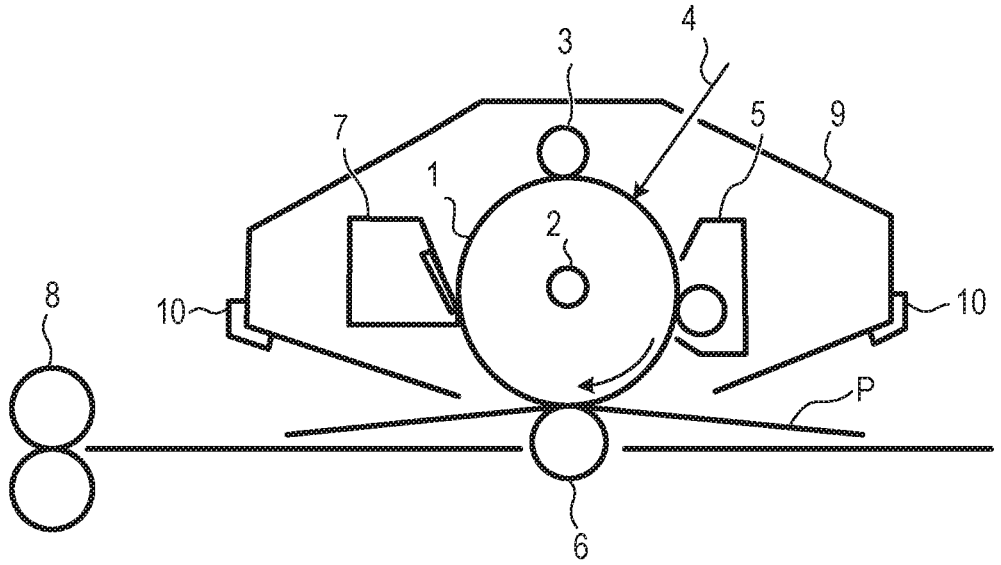
FIG. 1 is a view for illustrating an example of the schematic construction of an electrophotographic apparatus including a process cartridge.

Preferred embodiments of the present invention will now be described in detail in accordance with the accompanying drawings.

The present invention is described in detail below by way of preferred embodiments.

The inventors of the present invention have made an investigation, and as a result, have found that when a charging member that has been used in a related-art process cartridge is combined with an electrophotographic photosensitive member whose surface layer has a high hardness, a fluctuation in charging potential of the photosensitive member becomes particularly remarkable. This is probably because of the following reason. The charging member has a high surface hardness and hence has small deformability. Accordingly, when toner remaining on the electrophotographic photosensitive member passes an abutting portion between the electrophotographic photosensitive member and the charging member, the toner receives a stress by a pressing force to largely deform, thereby particularly strongly adhering to the electrophotographic photosensitive member.

To solve the technical problem, the inventors of the present invention have made an investigation, and as a result, have found that even when the hardness of the surface layer of the electrophotographic photosensitive member is high, the use of a charging member having a specific surface hardness and a specific adhesiveness suppresses the strong adhesion of the toner to the surface layer of the electrophotographic photosensitive member, and at the same time, can suppress the adhesion of the toner to the surface of the charging member. Thus, there can be provided a process cartridge and an electrophotographic apparatus each suppressed in fluctuation in charging potential at the time of its long-term use.

The inventors of the present invention have assumed the reason why even when the hardness of the surface layer of an electrophotographic photosensitive member is high, a fluctuation in charging potential of the photosensitive member at the time of its long-term use is suppressed by using a charging member having a specific surface hardness and a specific adhesiveness as a charging member configured to charge the electrophotographic photosensitive member to be as described below.

First, a reduction in surface hardness of the charging member suppresses the deformation of toner remaining on the electrophotographic photosensitive member. The inventors have considered that this is because when the toner passes an abutting portion between the electrophotographic photosensitive member and the charging member, the charging member largely deforms to alleviate a stress acting on the toner by a pressing force.

Further, a reduction in adhesiveness of the surface of the charging member reduces the amount of the toner migrating from the surface of the electrophotographic photosensitive member to the surface of the charging member. The inventors have considered that this is because the low adhesiveness of the surface of the charging member reduces an adhesive force acting between the charging member and the toner.

The inventors have considered that the above-mentioned effects suppress the strong adhesion of the toner to the surface layer of the electrophotographic photosensitive member, and at the same time, also suppress the migration of the toner from the electrophotographic photosensitive member to the charging member. The inventors have assumed that as a result of the foregoing, even when a process cartridge is used over a long time period, a fluctuation in charging potential thereof is suppressed.

Specifically, a significant toner adhesion-suppressing effect is observed in the following case: in a process cartridge including an electrophotographic photosensitive member having a surface layer containing a resin and a charge-transporting substance, and a charging member configured to charge the electrophotographic photosensitive member, the average of the Martens hardnesses (HMD) of the surface layer measured at a pushing force of 7 mN is 245 N/mm2 or more, and, in the core defined by three-dimensional surface texture standards (ISO 25178-2:2012) of the surface of the charging member, the average (HMC) of Martens hardnesses measured at a pushing force of 0.04 mN is 2 N/mm2 or more and 20 N/mm2 or less, and the average (Vc) of adhesivenesses measured with a scanning probe microscope in a field of view of 2-micrometer square is 70 mV or less.

When the HMC is more than 20 N/mm2, a stress that toner receives when passing an abutting portion between the electrophotographic photosensitive member and the charging member cannot be sufficiently alleviated, and hence the toner deforms to strongly adhere to the electrophotographic photosensitive member. In addition, when the HMC is less than 2 N/mm2, there is a problem in that the surface of the charging member is so soft that the embedding sticking of the toner to the surface of the charging member occurs. In addition, when the Vc is more than 70 mV, there occurs a problem in that an adhesive force between the surface of the charging member and the toner increases to stick the toner to the surface of the charging member.

The surface of the charging member according to the present invention has an HMC of 2 N/mm2 or more and 20 N/mm2 or less, and a Vc of 70 mV or less in its core.

The surface of the charging member according to the present invention preferably contains a vulcanizate of a rubber composition containing a polymer having a butadiene skeleton. A Martens hardness specified in the charging member according to the present invention is the hardness of a portion having a depth from the surface of the charging member of from several tens of nanometers to several hundreds of nanometers, and a adhesiveness measured with the scanning probe microscope is the adhesiveness of a portion having a depth from the surface of several nanometers. The rubber composition having the butadiene skeleton is preferred because of the following reason. A double bond easily remains even after the vulcanization of the composition, and hence only a portion having a depth from the surface of several nanometers can be oxidized and cured. Accordingly, a charging member having the HMC and the Vc in the core of the surface of the charging member is obtained.

In addition, the surface layer of the charging member is preferably roughened by insulating particles exposed from the surface layer. This is because of the following reason. When the surface layer is roughened by the exposed insulating particles, strong discharge is caused by the charge-up of peaks from which the insulating particles are exposed, and hence a fine surface potential gradient of the electrophotographic photosensitive member that is sharp and has a large potential difference can be produced. Thus, the movement of the toner, which has adhered to the surface of the charging member and has been charged to a charge opposite to that of the electrophotographic photosensitive member by the discharge from the charging member to the electrophotographic photosensitive member, to the peaks in the surface layer of the charging member is promoted, and hence a fluctuation in surface potential of the photosensitive member can be more effectively suppressed. The phrase "exposed from the surface layer" means that the insulating particles are exposed to the tops of at least peaks having close distances to the electrophotographic photosensitive member out of the peaks formed by particles present in plurality on the surface of the charging member.

The average of the Martens hardnesses of protruding peaks defined by the three-dimensional surface texture standards (ISO 25178-2:2012) in the roughened surface measured at a pushing force of 0.04 mN is preferably smaller than the HMC. This is because of the following reason. At the time of abutment between the electrophotographic photosensitive member and the charging member, the protruding peaks may apply, to the adhering toner, a stress larger than that applied by the core. Accordingly, when the average hardness of the protruding peaks is made lower than that of the core, the elastic deformation of the protruding peaks is promoted, and hence the sticking of the toner adhering to the surface of the charging member due to the deterioration of the toner can be more effectively suppressed. In addition, a distance between the toner on the surface of the charging member and the electrophotographic photosensitive member in the abutting portion is brought closer to such a distance that the toner is easily affected by the surface potential gradient of the electrophotographic photosensitive member by the elastic deformation of the protruding peaks, and hence the movement of the toner adhering to the charging member can be further promoted.

Figure 2:
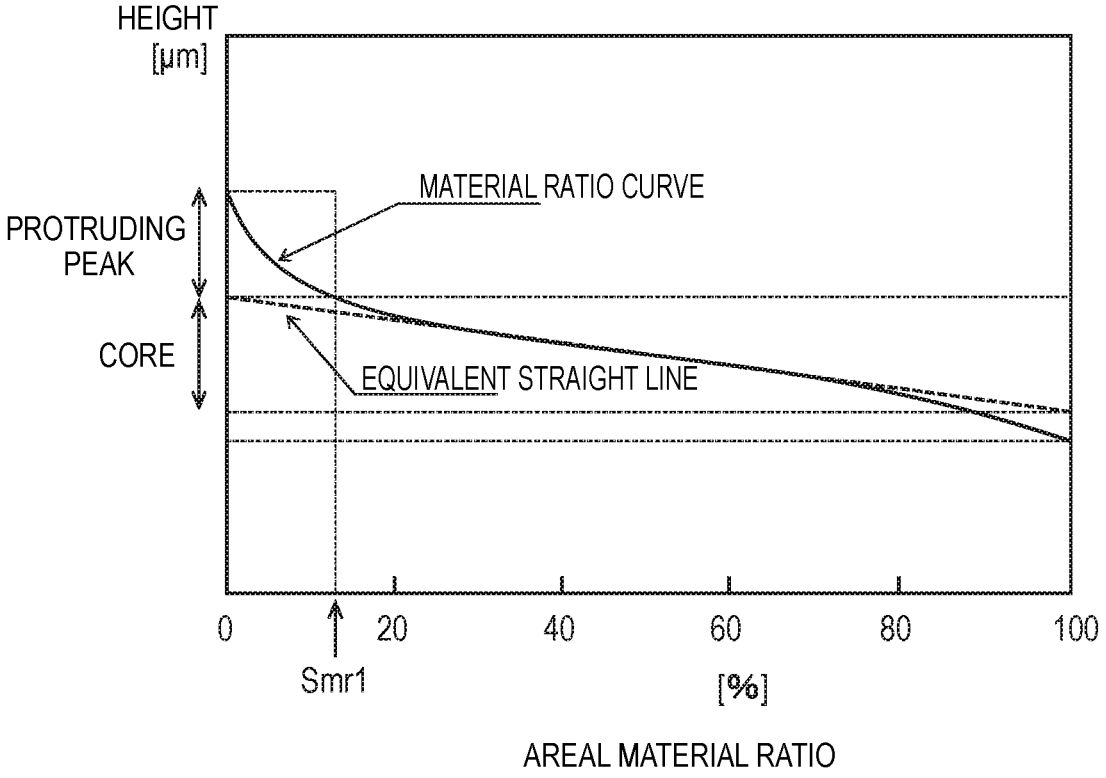
FIG. 2 is an explanatory graph for showing a core and a protruding peak defined by three-dimensional surface texture standards.

In the charging member according to one embodiment of the present invention, the core and the protruding peak are terms defined by the three-dimensional surface texture standards (ISO 25178-2:2012). Those terms are described with reference to FIG. 2. A curve representing the height at which the areal ratio of a region having a surface and having a certain height or more becomes from 0% to 100% is referred to as "material ratio curve."

When the lowest-gradient straight line (equivalent straight line) is drawn from the material ratio curve, a height corresponding to an areal material ratio of 0% and a height corresponding to an areal material ratio of 100% are determined in the equivalent straight line.

The core is a portion included in the range of from the height corresponding to an areal material ratio of 0% to the height corresponding to an areal material ratio of 100% in the equivalent straight line. The protruding peak is a portion protruding upward from the core, and is a portion corresponding to the range of from an areal material ratio of 0% to an areal material ratio of Smr1% in the material ratio curve. The Smr1 is the areal material ratio at which the protruding peak and the core are separated from each other.

The insulating particles are preferably balloon-shaped particles of an insulating resin. This is because in the case where the surface layer is roughened by balloon-shaped particles exposed from the surface layer, because of high insulating properties of air layers in the balloon-shaped particles, strong discharge by the charge-up of protruded portions formed of the insulating particles exposed from the surface layer can be caused effectively as compared to the case of solid particles. In addition, the balloon-shaped particles can undergo elastic deformation more easily than the solid particles can because of the influences of the air layers in the particles. Accordingly, the distance between the toner on the surface of the charging member and the electrophotographic photosensitive member in the abutting portion is brought closer to such a distance that the toner is easily affected by the surface potential gradient of the electrophotographic photosensitive member, and hence the movement of the toner adhering to the charging member can be further promoted.

The surface layer of the electrophotographic photosensitive member according to the present invention has a feature of having an HMD of 245 N/mm2 or more. Specific examples of the surface layer of the electrophotographic photosensitive member are described below.

In the surface layer of the electrophotographic photosensitive member according to the present invention, it is preferred that the surface layer containing the charge-transporting substance contain a polyester resin or a polycarbonate resin, and the polyester resin have structures represented by the general formula (I) and the general formula (II).

(I)

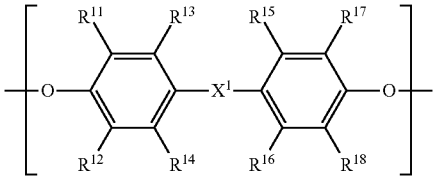

In the general formula (I), X1 represent a single bond, an alkylidene group, or a cycloalkylidene group. R11 to R18 each independently represent a hydrogen atom or an alkyl group.

Examples of the alkylidene group represented by X1 include a methylidene group, an ethylidene group, a propylidene group, a butylidene group, a pentylidene group, and a hexylidene group.

In addition, examples of the cycloalkylidene group represented by X1 include a cyclopropylidene group, a cyclobutylidene group, a cyclopentylidene group, a cyclohexylidene group, a cycloheptylidene group, a cyclooctylidene group, a cyclononylidene group, a cyclodecylidene group, a cycloundecylidene group, and a cyclododecylidene group.

Examples of the alkyl group represented by each of R11 to R18 include a methyl group, an ethyl group, a n-propyl group, an isopropyl group, a n-butyl group, a sec-butyl group, a tert-butyl group, and an isobutyl group.

(II)

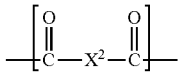

In the general formula (II), X2 represents a divalent group.

Examples of the divalent group represented by X2 include a divalent group derived from phenylene, naphthanylene, or biphenyl, and a divalent group derived from biphenyl ether.

Examples of the structure represented by the general formula (I) include structures represented by the following formulae (I-1) to (I-10). Of those, at least one of the structures each represented by the formula (I-1), the formula (I-2), the formula (I-3), or the formula (I-4) is preferred.

(I-1)

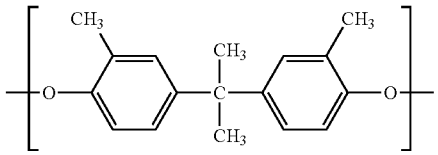

(I-2)

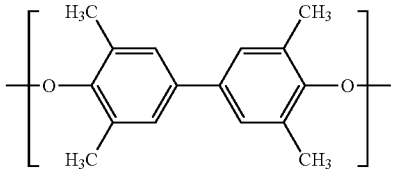

(I-3)

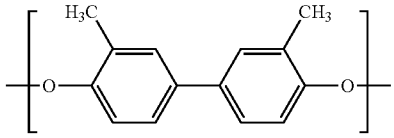

(I-4)

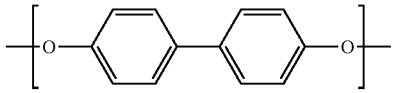

(I-5)

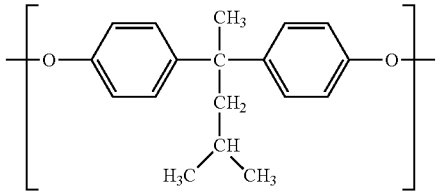

-continued (I-6)

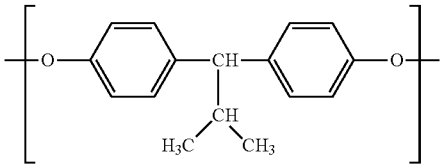

(I-7)

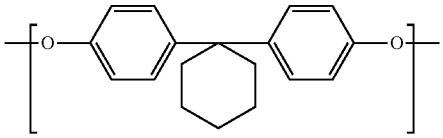

(I-8)

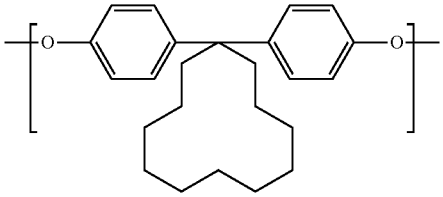

(I-9)

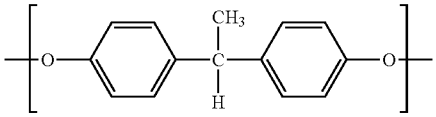

(I-10)

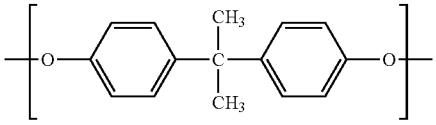

Examples of the structure represented by the general formula (II) include structures derived from dicarboxylic acids, such as terephthalic acid, isophthalic acid, biphenyldicarboxylic acid, an aliphatic dicarboxylic acid, and naphthalenedicarboxylic acid. Specific examples thereof include the following structure examples.

(II-1)

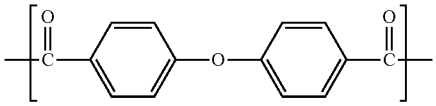

(II-2)

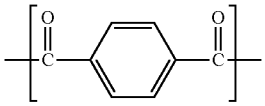

(II-3)

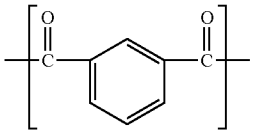

(II-4)

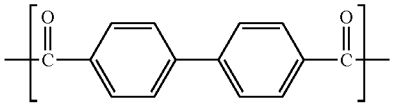

-continued (II-5)

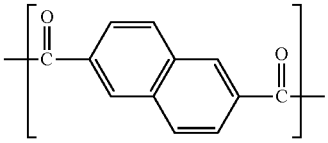

Of those, at least one of the structures represented by the formula (II-1), the formula (II-2), and the formula (II-3) is preferably incorporated into the polyester resin.

The polycarbonate resin that the surface layer of the electrophotographic photosensitive member according to the present invention contains preferably has a structure represented by the general formula (III).

(III)

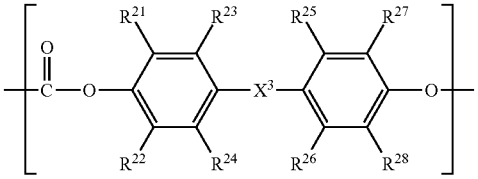

In the general formula (III), $X^3$ represents a single bond, an oxygen atom, an alkylidene group, or a cycloalkylidene group. $R^{21}$ to $R^{28}$ each independently represent a hydrogen atom or an alkyl group.

Examples of the alkylidene group represented by $X^3$ include a methylidene group, an ethylidene group, a propylidene group, a butylidene group, a pentylidene group, and a hexylidene group.

In addition, examples of the cycloalkylidene group represented by $X^3$ include a cyclopropylidene group, a cyclobutylidene group, a cyclopentylidene group, a cyclohexylidene group, a cycloheptylidene group, a cyclooctylidene group, a cyclononylidene group, a cyclodecylidene group, a cycloundecylidene group, and a cyclododecylidene group.

Examples of the alkyl group represented by each of $R^{21}$ to $R^{28}$ include a methyl group, an ethyl group, a n-propyl group, an isopropyl group, a n-butyl group, a sec-butyl group, a tert-butyl group, and an isobutyl group.

In addition, the structure represented by the general formula (III) is preferably a polycarbonate resin containing a structure represented by the general formula (III-1).

(III-1)

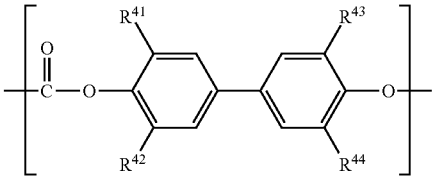

In the general formula (III-1), $R^{41}$ to $R^{44}$ each independently represent a hydrogen atom or a methyl group.

Examples of the structure represented by the general formula (III-1) include structures represented by the following formulae (III-1-1), (III-1-2), and (III-1-3). Of those, at least one of the structures each represented by the formula (III-1-1) or the formula (III-1-2) is preferably incorporated into the polycarbonate resin.

(III-1-1)

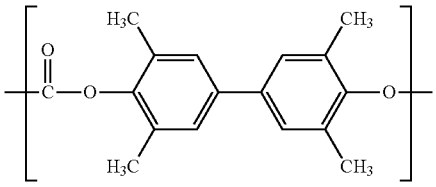

(III-1-2)

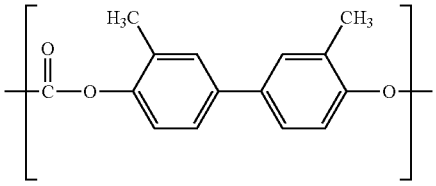

(III-1-3)

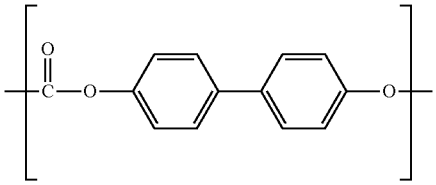

The ease with which toner adheres to the surface of the electrophotographic photosensitive member is affected by an interaction between a polar group of the resin forming the surface layer of the electrophotographic photosensitive member and a polar group of a resin forming the toner. The inventors have considered that when the polyester resin or the polycarbonate resin described above is used, the polarity of the molecular chain of the resin becomes smaller to weaken its interaction with the toner, and hence the adhesion of the toner to the surface of the electrophotographic photosensitive member is further suppressed. The inventors have considered that as a result of the foregoing, the amount of the toner migrating from the surface of the electrophotographic photosensitive member to the surface of the charging member reduces, and hence even when the process cartridge is used over a long time period, a fluctuation in charging potential thereof is further suppressed.

In addition, in the present invention, the polycarbonate resin may have a structure except the structure represented by the general formula (III-1) on its main chain skeleton. Examples of the structure except the structure represented by the general formula (III-1) include structures represented by the following formulae (III-2-1) to (III-2-7).

(III-2-1)

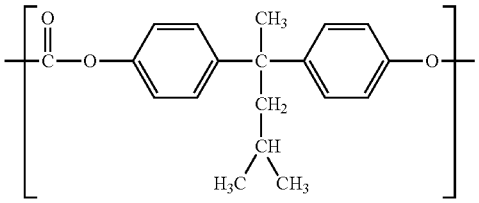

-continued (III-2-2)

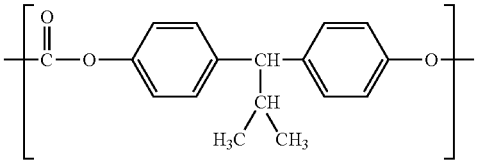

(III-2-3)

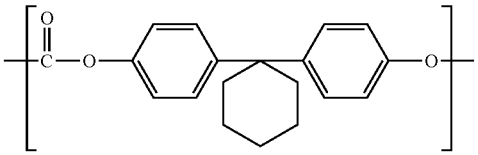

(III-2-4)

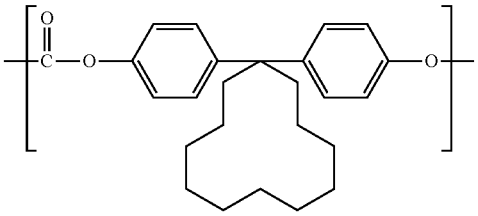

(III-2-5)

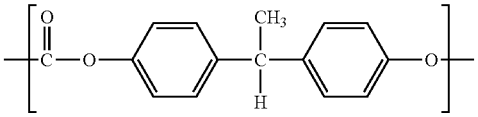

(III-2-6)

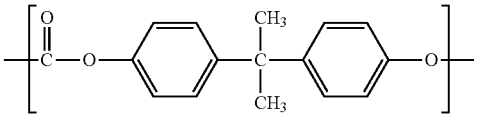

(III-2-7)

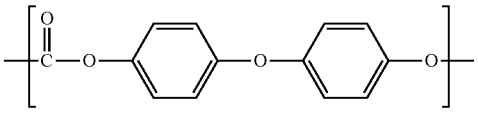

The polycarbonate resin preferably has a structure represented by the formula (III-2-1), (III-2-2), (III-2-3), or (III-2-4) out of those structures because the fluctuation in charging potential can be suppressed.

Further, it is preferred that the ratio of the structure represented by the general formula (I-2) to the structure represented by the general formula (I) in the polyester resin be 30 mol % or more, or the ratio of the structure represented by the general formula (III-1) to the structure represented by the general formula (III) in the polycarbonate resin be 30 mol % or more in terms of the suppression of the fluctuation in charging potential. In addition, a polyester resin containing 35 mol % or more of the structure represented by the general formula (I-2) in the structure represented by the general formula (I), or a polycarbonate resin containing 35 mol % or more of the structure represented by the general formula (III-1) in the structure represented by the general formula (III) is preferred because the fluctuation in charging potential can be further suppressed.

In the electrophotographic photosensitive member according to the present invention, the surface layer containing the charge-transporting substance may further contain silica particles.

In particular, the surface layer preferably contains 1 mass % or more and 10 mass % or less of silica particles having an average primary particle diameter of 40 nm or more and 200 nm or less with respect to the solid content of the polyester resin or the polycarbonate resin.

The inventors have considered that when the silica particles are added to the surface layer of the electrophotographic photosensitive member according to the present invention to provide irregularities on the surface, a contact area at the time of the contact of toner with the electrophotographic photosensitive member reduces to further suppress the adhesion of the toner to the surface of the electrophotographic photosensitive member. The inventors have considered that as a result of the foregoing, the amount of the toner migrating from the surface of the electrophotographic photosensitive member to the surface of the charging member reduces, and hence even when the process cartridge is used over a long time period, the fluctuation in charging potential thereof is further suppressed.

The silica particles are, for example, synthetic silica. Examples of the synthetic silica include dry silica particles and wet silica particles.

Examples of the dry silica particles include: silica particles based on a burning method obtained by burning a silane compound; and silica particles based on a deflagration method obtained by explosively burning metal silicon powder.

Examples of the wet silica particles include: wet silica particles obtained by a neutralization reaction between sodium silicate and a mineral acid; colloidal silica particles obtained by making an acidic silicic acid alkaline and polymerizing the acid; and sol-gel method silica particles obtained by the hydrolysis of an organosilane compound.

Of those, the silica particles based on the burning method are preferred in terms of electrical characteristics. When the wet silica particles are used, silica that is reduced in amount of impurities, such as an alkali, by purification or the like is preferred.

When the average primary particle diameter of the silica particles is less than 40 nm, a suppressing effect on the adhesion of the toner to the surface of the electrophotographic photosensitive member is not sufficiently obtained. When the average primary particle diameter of the silica particles is more than 200 nm, the deterioration of the flaw resistance of the electrophotographic photosensitive member due to the detachment of the silica particles from the surface of the electrophotographic photosensitive member is observed.

A method of measuring the average primary particle diameter of the silica particles is as described below.

The silica particles are separated from the surface layer of the electrophotographic photosensitive member according to the present invention, and 100 primary particles of the silica particles are observed with a scanning electron microscope (SEM) at a magnification of 100,000. The longest diameter and shortest diameter of each of the primary particles are measured, and a sphere-equivalent diameter is measured from an intermediate value therebetween. A 50% diameter (D50v) in the cumulative frequency of the resultant sphere-equivalent diameters was determined, and the diameter was defined as the average primary particle diameter of the silica particles.

The particle size distribution of the silica particles is preferably a particle size distribution in which the volume distribution cumulative value of diameters equal to or less than one half of the average primary particle diameter is 10 vol % or less, and the volume distribution cumulative value of diameters twice or more as large as the average primary particle diameter is 10 vol % or less.

[Martens Hardness of Surface Layer of Electrophotographic Photosensitive Member]

A site where the Martens hardness of the surface layer of the electrophotographic photosensitive member is measured is one arbitrary site in each of regions obtained by uniformly dividing the longitudinal direction of the electrophotographic photosensitive member in 10. That is, the total number of the measurement sites is 10. The Martens hardness of the surface layer of the electrophotographic photosensitive member may be measured by using a microhardness-measuring apparatus (product name: PICODENTOR HM500, manufactured by Fischer Instruments). The measurement can be performed under an environment having a temperature of 25° C. and a relative humidity of 50% by bringing a quadrangular pyramid-type diamond indenter into contact with a measurement site according to a condition for a pushing speed represented by the following equation (1).

$$dF/dt = 14 \text{ mN}/10 \text{ s} \quad (1)$$

In the equation, F represents a force and t represents a time period. In the evaluation of the surface layer of the electrophotographic photosensitive member, the average of the Martens hardnesses (HMD) is obtained by: sampling a hardness when the indenter is pushed into the surface layer with a force of 7 mN from the measurement results; and averaging the values measured at the 10 sites. The method of measuring the HMD is represented by "Evaluation 1" in Examples.

[Martens Hardness of Surface of Charging Member]

A site where the Martens hardness of the surface of the charging member is measured is one arbitrary site in each of the regions of a core or protruding peaks obtained by uniformly dividing the longitudinal direction of the charging member in 10. That is, the total number of the measurement sites is 10. The Martens hardness of the surface of the charging member may be measured by using a microhardness-measuring apparatus (product name: PICODENTOR HM500, manufactured by Fischer Instruments) and a microscope attached thereto after the identification of the core defined by the three-dimensional surface texture standards (ISO 25178-2:2012) with a confocal microscope (product name: OPTELICS HYBRID, manufactured by Lasertec Corporation). The core is identified by: subjecting the entirety of the height image of the surface observed at an objective lens magnification of 20, a pixel number of 1,024 pixels, and a height resolution of 0.1 μm to curved surface correction; subjecting the corrected image to three-dimensional measurement; and binarizing the height image with the measured Sk value. The Martens hardness may be measured under an environment having a temperature of 25° C. and a relative humidity of 50% with the microscope attached to the microhardness-measuring apparatus by bringing a quadrangular pyramid-type diamond indenter into contact with the core identified with the white confocal microscope according to a condition for a pushing speed represented by the following equation (1).

$$dF/dt = 0.1 \text{ mN}/10 \text{ s} \quad (1)$$

In the equation, F represents a force and t represents a time period.

The average of the Martens hardnesses (HMC) of the core is obtained by: sampling a hardness when the indenter is pushed into the surface with a force of 0.04 mN from the measurement results; and averaging the values measured at the 10 sites. The measurement result of the HMC is represented by "Evaluation 2" in Examples. The average of the Martens hardnesses of the protruding peaks is also obtained by the same approach.

[Adhesiveness of Surface of Charging Member]

As in the case of the Martens hardness measurement, a site where the adhesiveness of the surface of the charging member is measured is one arbitrary site in each of regions obtained by uniformly dividing the longitudinal direction of the charging member in 10. That is, the total number of the measurement sites is 10. The measurement is performed in a field of view of 2-micrometer square (measuring 2 μm long by 2 μm wide) by using adhesiveness-elasticity mapping as a measurement mode, AC160FS (manufactured by Olympus Corporation) as a probe, and a spring constant of the probe of 38.7 N/m, and by using the measurement conditions of a scan rate of 2 Hzm, a scan range of 2 μm, a free amplitude of 2 V, and a set point of 1 V. The average (Vc) of the adhesivenesses is obtained by averaging the values measured at the 10 sites. The measurement result of the Vc is represented by "Evaluation 3" in Examples.

[Electrophotographic Photosensitive Member]

The electrophotographic photosensitive member according to the present invention includes a support and a photosensitive layer, and includes the surface layer containing the charge-transporting substance and the resin. The photosensitive layers of electrophotographic photosensitive members are mainly classified into (1) a laminated photosensitive layer and (2) a single-layer-type photosensitive layer. (1) The laminated photosensitive layer has a charge-generating layer containing a charge-generating substance and a charge-transporting layer containing the charge-transporting substance. (2) The single-layer-type photosensitive layer has a photosensitive layer containing both the charge-generating substance and the charge-transporting substance. In the electrophotographic photosensitive member according to the present invention, when the photosensitive layer is (1) the laminated photosensitive layer, the charge-transporting layer serves as the surface layer, and when the photosensitive layer is (2) the single-layer-type photosensitive layer, the photosensitive layer serves as the surface layer.

A method of producing the electrophotographic photosensitive member is, for example, a method involving: preparing coating liquids for the respective layers to be described later; applying the liquids in a desired layer order; and drying the liquids. At this time, a method of applying each of the coating liquids is, for example, dip coating, spray coating, curtain coating, or spin coating. Of those, dip coating is preferred from the viewpoints of efficiency and productivity.

The respective layers are described below.

<Electroconductive Layer>

In the electrophotographic photosensitive member according to the present invention, an electroconductive layer may be arranged on the support. The arrangement of the electroconductive layer can conceal flaws and irregularities in the surface of the support, and control the reflection of light on the surface of the support.

The electroconductive layer preferably contains electroconductive particles and a resin.

A material for the electroconductive particles is, for example, a metal oxide, a metal, or carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, a metal oxide is preferably used as the electroconductive particles, and in particular, titanium oxide, tin oxide, and zinc oxide are more preferably used.

When the metal oxide is used as the electroconductive particles, the surface of the metal oxide may be treated with a silane coupling agent or the like, or the metal oxide may be doped with an element, such as phosphorus or aluminum, or an oxide thereof.

In addition, each of the electroconductive particles may be of a laminated construction having a core particle and a coating layer coating the particle. Examples of the core particle include titanium oxide, barium sulfate, and zinc oxide. The coating layer is, for example, a metal oxide, such as tin oxide.

In addition, when the metal oxide is used as the electroconductive particles, their volume-average particle diameter is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the electroconductive layer may further contain, for example, a silicone oil, resin particles, or a concealing agent, such as titanium oxide.

The average thickness of the electroconductive layer is preferably 1 μm or more and 50 μm or less, particularly preferably 3 μm or more and 40 μm or less.

The electroconductive layer may be formed by: preparing a coating liquid for an electroconductive layer containing the above-mentioned respective materials and a solvent; forming a coat of the liquid; and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing the electroconductive particles in the coating liquid for an electroconductive layer, there are given methods using a paint shaker, a sand mill, a ball mill, and a liquid collision-type high-speed disperser.

<Undercoat Layer>

In the electrophotographic photosensitive member according to the present invention, an undercoat layer may be arranged on the support or the electroconductive layer. The arrangement of the undercoat layer can improve an adhesive function between layers to impart a charge injection-inhibiting function.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron-transporting substance, a metal oxide, a metal, an electroconductive polymer, and the like for the purpose of improving electric characteristics. Of those, an electron-transporting substance and a metal oxide are preferably used.

Examples of the electron-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound.

An electron-transporting substance having a polymerizable functional group may be used as the electron-transporting substance and copolymerized with the above-mentioned monomer having a polymerizable functional group to form an undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the undercoat layer may further contain an additive.

The average thickness of the undercoat layer is preferably 0.1 μm or more and 50 μm or less, more preferably 0.2 μm or more and 40 μm or less, particularly preferably 0.3 or more and 30 μm or less.

The undercoat layer may be formed by: preparing a coating liquid for an undercoat layer containing the above-mentioned respective materials and a solvent; forming a coat of the liquid; and drying and/or curing the coat. Examples of the solvent to be used for the coating liquid include an alcohol-based solvent, a ketone-based solvent, an ether-based solvent, an ester-based solvent, and an aromatic hydrocarbon-based solvent.

<Photosensitive Layer>

(1) Laminated Photosensitive Layer

The laminated photosensitive layer includes a charge-generating layer and a charge-transporting layer.

(1-1) Charge-Generating Layer

The charge-generating layer preferably contains a charge-generating substance and a resin.

Examples of the charge-generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge-generating substance in the charge-generating layer is preferably 40 mass % or more and 85 mass % or less, more preferably 60 mass % or more and 80 mass % or less with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is more preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The average thickness of the charge-generating layer is preferably 0.1 μm or more and 1 μm or less, more preferably 0.15 μm or more and 0.4 μm or less.

The charge-generating layer may be formed by: preparing a coating liquid for a charge-generating layer containing the above-mentioned respective materials and a solvent; forming a coat of the liquid; and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

The charge-transporting layer contains a charge-transporting substance and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances.

In addition, a plurality of kinds of charge-transporting substances may be incorporated together into the layer. Compounds represented by the formulae (CTM-1) to (CTM-10) are shown below as specific examples of the charge-transporting sub stance.

(CTM-1)

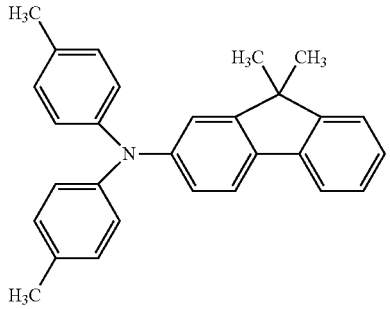

(CTM-2)

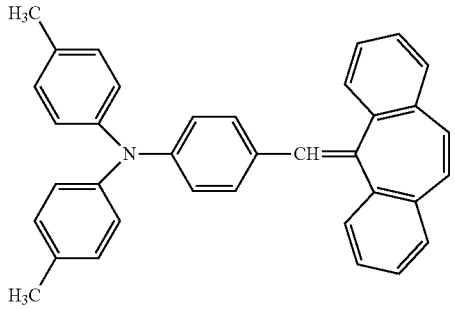

-continued
(CTM-3)
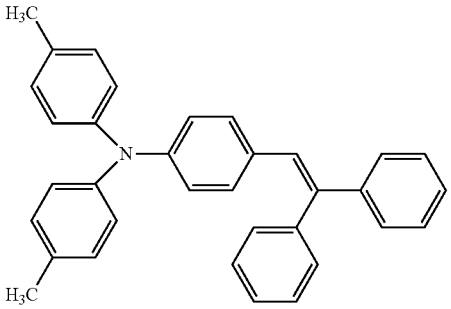
(CTM-4)
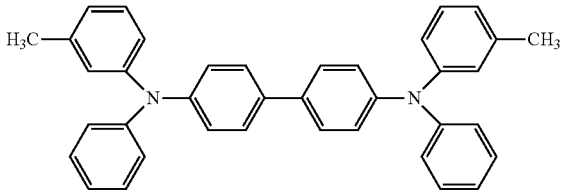
(CTM-5)
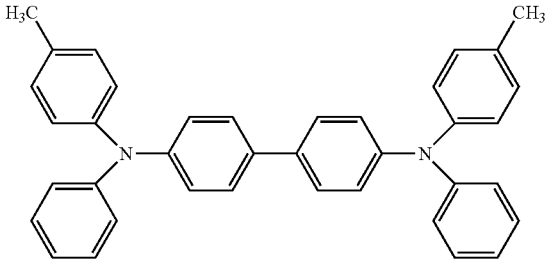
(CTM-6)
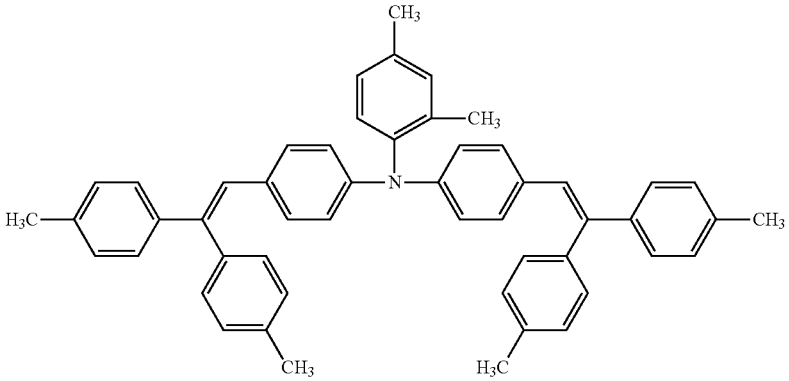
(CTM-7)
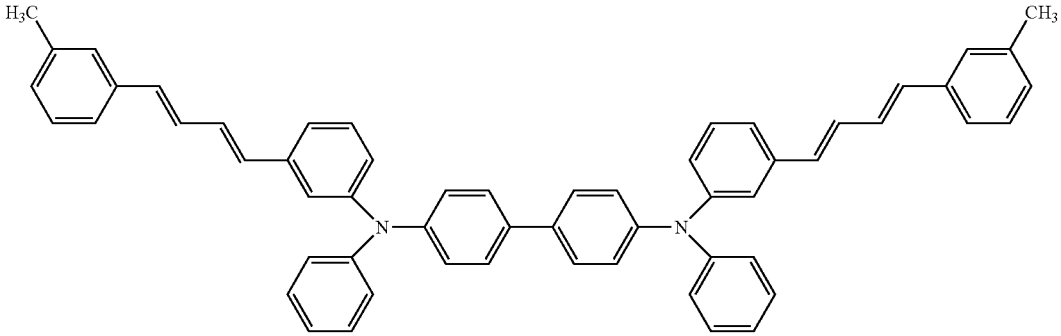

-continued (CTM-8)

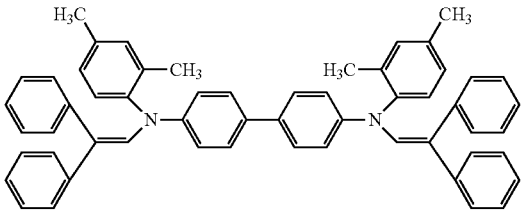

(CTM-9)

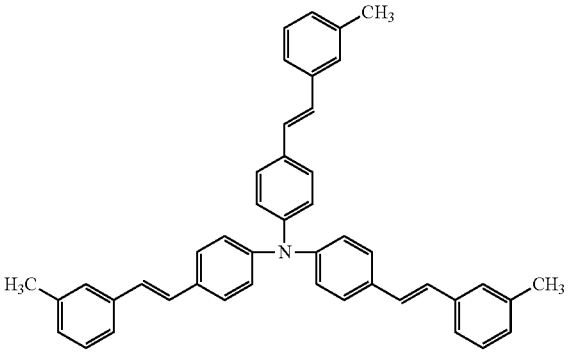

(CTM-10)

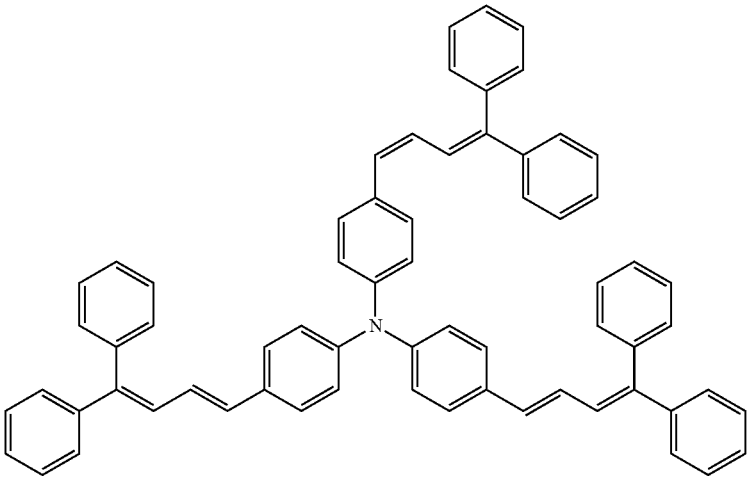

The content of the charge-transporting substance in the charge-transporting layer is preferably 20 mass % or more and 60 mass % or less, more preferably 30 mass % or more and 50 mass % or less with respect to the total mass of the charge-transporting layer.

The resin that the charge-transporting layer contains is, for example, a polyester resin or a polycarbonate resin. As described above, the polyester resin is preferably a polyester resin having structures represented by the general formula (I) and the general formula (II), and the polycarbonate resin is preferably a polycarbonate resin having a structure represented by the general formula (III).

A content ratio (mass ratio) between the charge-transporting substance and the resin in the charge-transporting layer is preferably from 4:10 to 20:10, more preferably from 5:10 to 10:10.

The charge-transporting layer may be formed by: forming a coat of a coating liquid for a charge-transporting layer prepared by dissolving the charge-transporting substance and the resin in a solvent; and drying the coat. The solvent to be used in the coating liquid for forming the charge-transporting layer is, for example, an alcohol-based solvent, a sulfoxide-based solvent, a ketone-based solvent, an ether-based solvent, an ester-based solvent, or an aromatic hydrocarbon solvent.

In addition, the charge-transporting layer may contain an additive, such as an antioxidant, a UV absorber, a plasticizer, a leveling agent, a sliding property-imparting agent, or a wear resistance-improving agent.

Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, alumina particles, and boron nitride particles.

The average thickness of the charge-transporting layer is preferably 5 or more and 50 μm or less, more preferably 8 μm or more and 40 μm or less, particularly preferably 10 μm or more and 30 μm or less.

The charge-transporting layer may be formed by: preparing a coating liquid for a charge-transporting layer containing the above-mentioned respective materials and a solvent; forming a coat of the liquid; and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

(2) Single-Layer-Type Photosensitive Layer

The single-layer-type photosensitive layer may be formed by: preparing a coating liquid for a photosensitive layer containing the charge-generating substance, the charge-transporting substance, the resin, and a solvent; forming a coat of the liquid; and drying the coat. The same materials as the examples of the materials in "(1) the laminated photosensitive layer" described above may be used as the charge-generating substance, the charge-transporting substance, and the resin.

The average thickness of the single-layer-type photosensitive layer is preferably 10 μm or more and 45 μm or less, more preferably 25 μm or more and 35 μm or less.

[Charging Member]

The construction of a charging roller is given as an example of the charging member according to the present invention. The charging roller is formed of an electroconductive support and an electroconductive elastic layer formed on the electroconductive support. The respective components forming the charging member are sequentially described below.

<Electroconductive Support>

The electroconductive support is not particularly limited as long as the support has electroconductivity, can support the electroconductive elastic layer and the like, and can maintain a strength as the charging member, or typically as the charging roller. When the charging member is the charging roller, the electroconductive support is a solid columnar body or a hollow cylindrical body, and its length is, for example, from about 240 mm to about 360 mm, and its outer diameter is, for example, from about 4.5 mm to about 9 mm.

<Electroconductive Elastic Layer>

The electroconductive elastic layer preferably has an electroconductive elastic body containing a vulcanizate of a rubber composition containing a polymer having a butadiene skeleton, and the volume resistivity of the rubber composition is preferably $10^3$ Ω·cm or more and $10^9$ Ω·cm or less. In addition, the electroconductive elastic body is preferably a vulcanizate of a rubber composition obtained by appropriately blending the polymer having a butadiene skeleton with an ionic electroconductive agent, electroconductive particles, a crosslinking agent, and the like.

A butadiene rubber, an isoprene rubber, a chloroprene rubber, an acrylonitrile-butadiene rubber, a styrene-butadiene rubber, a styrene-butadiene-styrene rubber, or the like is suitably used as the polymer having a butadiene skeleton.

Mechanisms via which electroconductivity is imparted to the rubber composition are roughly classified into two mechanisms, that is, an ionic electroconductive mechanism and an electronic electroconductive mechanism.

The polymer having a butadiene skeleton to be used in the ionic electroconductive mechanism is particularly preferably a polar rubber typified by a chloroprene rubber or an acrylonitrile-butadiene rubber. Examples of the ionic electroconductive agent to be used in the ionic electroconductive mechanism include: an ionic electroconductive agent containing an inorganic ionic substance; an ionic electroconductive agent containing a quaternary ammonium salt; and an ionic electroconductive agent formed of an inorganic salt of an organic acid. Examples of the ionic electroconductive agent containing an inorganic ionic substance include lithium perchlorate, sodium perchlorate, and calcium perchlorate. Examples of the ionic electroconductive agent containing a quaternary ammonium salt include lauryltrimethylammonium chloride, stearyltrimethylammonium chloride, and tetrabutylammonium perchlorate. Examples of the ionic electroconductive agent formed of an inorganic salt of an organic acid include lithium trifluoromethanesulfonate and potassium perfluorobutanesulfonate. Those compounds may be used alone or in combination thereof. Of those ionic electroconductive agents, a quaternary ammonium salt of perchloric acid is preferred because the salt has stable resistance to an environmental change.

The usage amount of any such ionic electroconductive agent may be appropriately selected in accordance with the kinds of a raw material rubber, the ionic electroconductive agent, and any other blending agent so that the rubber composition may have a desired electrical resistance value. For example, the usage amount of the ionic electroconductive agent may be set to 0.1 part by mass or more and 20 parts by mass or less, preferably 0.2 part by mass or more and 10 parts by mass or less with respect to 100 parts by mass of the raw material rubber.

The rubber composition containing the polymer having a butadiene skeleton containing the polar rubber, may be used as the polymer having a butadiene skeleton to be used in the electronic electroconductive mechanism. The electroconductive particles to be used in the electronic electroconductive mechanism are preferably, for example, carbon black, carbon fibers, graphite, metal fine powder, or a metal oxide. The rubber composition to which electroconductivity has been imparted via the electronic electroconductive mechanism has, for example, the following advantages: the composition is reduced in temperature and humidity dependence of its electrical resistance, is reduced in bleeding and blooming, and is inexpensive as compared to the rubber composition to which electroconductivity has been imparted via the ionic electroconductive mechanism. Accordingly, an electroconductive elastic body containing a vulcanizate of the rubber composition to which electroconductivity has been imparted via the electronic electroconductive mechanism is preferably used.

Examples of the electroconductive particles include the following: electroconductive carbons, such as Ketjen black EC and acetylene black; carbons for rubber, such as SAF, ISAF, HAF, FEF, GPF, SRF, FT, and MT; metals and metal oxides, such as tin oxide, titanium oxide, zinc oxide, copper, and silver; carbons for color (ink) subjected to oxidation treatment, pyrolytic carbon, natural graphite, and artificial graphite. The electroconductive particles are preferably free from forming a large convex portion on the surface of the electroconductive elastic layer, and particles having an average particle diameter of from 10 nm to 300 nm are preferably used.

The usage amount of those electroconductive particles may be appropriately selected in accordance with the kinds of the raw material rubber, the electroconductive particles, and any other blending agent so that the rubber composition may have a desired electrical resistance value. For example, the usage amount of the electroconductive particles may be set to 0.5 part by mass or more and 100 parts by mass or less, preferably 2 parts by mass or more and 60 parts by mass or less with respect to 100 parts by mass of the raw material rubber.

In addition, any other electroconductive agent, a filler, a processing aid, an age inhibitor, a crosslinking aid, a crosslinking accelerator, a crosslinking accelerator aid, a crosslinking retarder, a dispersant, or the like may be incorporated into the rubber composition.

<Insulating Particles>

When the surface layer of the charging member is roughened, insulating particles are preferably exposed to the surface of the charging member. The insulating particles only need to have such insulating properties that their volume resistivity is $10^{10}$ Ω·cm or more. The volume resistivity of the insulating particles may be measured by: pressurizing the insulating particles to pelletize the particles; and measuring the volume resistivity of the pellet with a powder resistivity-measuring apparatus (product name: POWDER RESISTIVITY MEASUREMENT SYSTEM MCP-PD51, manufactured by Mitsubishi Chemical Analytech Co., Ltd.). In order to pelletize the particles to be subjected to the measurement, the particles are loaded into the cylindrical chamber having a diameter of 20 mm of the powder resistivity-measuring apparatus. The particles are loaded in such an amount that the thickness of the pellet layer at the time of pressurization at 20 kN becomes from 3 mm to 5 mm. The measurement is performed under an environment having a temperature of 23° C. and a relative humidity of 50% at an applied voltage of 90 V and a load of 4 kN.

A material for the insulating particles is not particularly limited, and examples of the particles include particles formed of at least one resin selected from a phenol resin, a silicone resin, a polyacrylonitrile resin, a polystyrene resin, a polyurethane resin, a nylon resin, a polyethylene resin, a polypropylene resin, and an acrylic resin.

The shapes of the insulating particles are not particularly limited, and examples thereof include a spherical shape, an indefinite shape, a bowl shape, and a balloon shape. Of those, balloon-shaped particles are particularly preferred because the particles have high insulating properties by virtue of the presence of air layers in the particles, and can be elastically deformed by an abutting pressure between the photosensitive member and the charging member. Particles obtained by expanding thermally expandable microcapsules may be used as the balloon-shaped particles. The thermally expandable microcapsules are each a material having the following features: the material contains an encapsulated substance in its shell; and the application of heat expands the encapsulated substance to provide a balloon-shaped resin particle.

When the thermally expandable microcapsules are used, a thermoplastic resin needs to be used as a shell material. Examples of the thermoplastic resin include the following: an acrylonitrile resin, a vinyl chloride resin, a vinylidene chloride resin, a methacrylic acid resin, a styrene resin, a urethane resin, an amide resin, a methacrylonitrile resin, an acrylic acid resin, acrylate resins, and methacrylate resins. Of those, a thermoplastic resin formed of at least one kind selected from an acrylonitrile resin, a vinylidene chloride resin, and a methacrylonitrile resin is preferably used because the resin shows low gas permeability and high rebound resilience. Those thermoplastic resins may be used alone or in combination thereof. Further, monomers serving as raw materials for those thermoplastic resins may be copolymerized to provide a copolymer.

The encapsulated substance of each of the thermally expandable microcapsules is preferably a substance that gasifies at a temperature equal to or less than the softening point of the thermoplastic resin to expand, and examples thereof include the following: low-boiling point liquids, such as propane, propylene, butene, normal butane, isobutane, normal pentane, and isopentane; and high-boiling point liquids, such as normal hexane, isohexane, normal heptane, normal octane, isooctane, normal decane, and isodecane.

The thermally expandable microcapsules may be produced by a known production method, such as a suspension polymerization method, an interfacial polymerization method, an interfacial precipitation method, or a liquid drying method. In, for example, the suspension polymerization method, as an example, there may be given a method involving: mixing a polymerizable monomer, the substance to be encapsulated in each of the thermally expandable microcapsules, and a polymerization initiator; dispersing the mixture in an aqueous medium containing a surfactant and a dispersion stabilizer; and then subjecting the resultant to suspension polymerization. A compound having a reactive group that reacts with a functional group of the polymerizable monomer, or an organic filler may also be added to the aqueous medium.

Examples of the polymerizable monomer may include the following: acrylonitrile, methacrylonitrile, α-chloroacrylonitrile, α-ethoxyacrylonitrile, fumaronitrile, acrylic acid, methacrylic acid, itaconic acid, maleic acid, fumaric acid, citraconic acid, vinylidene chloride, and vinyl acetate; acrylates (methyl acrylate, ethyl acrylate, n-butyl acrylate, isobutyl acrylate, t-butyl acrylate, isobornyl acrylate, cyclohexyl acrylate, and benzyl acrylate); methacrylates (methyl methacrylate, ethyl methacrylate, n-butyl methacrylate, isobutyl methacrylate, t-butyl methacrylate, isobornyl methacrylate, cyclohexyl methacrylate, and benzyl methacrylate); and styrene-based monomers, acrylamide, substituted acrylamides, methacrylamide, substituted methacrylamides, butadiene, ε-caprolactam, polyether, and isocyanates. Those polymerizable monomers may be used alone or in combination thereof.

The polymerization initiator is preferably an initiator soluble in the polymerizable monomer, and a known peroxide initiator and a known azo initiator may each be used. Of those, the azo initiator is preferred. Examples of the azo initiator are listed below: 2,2'-azobisisobutyronitrile, 1,1'-azobis(cyclohexane-1-carbonitrile), and 2,2'-azobis-4-methoxy-2,4-dimethylvaleronitrile. Of those, 2,2'-azobisisobutyronitrile is preferred. The usage amount of the polymerization initiator is preferably from 0.01 part by mass to 5 parts by mass with respect to 100 parts by mass of the polymerizable monomer.

An anionic surfactant, a cationic surfactant, a nonionic surfactant, an amphoteric surfactant, or a polymer type dispersant may be used as the surfactant. The usage amount of the surfactant is preferably from 0.01 part by mass to 10 parts by mass with respect to 100 parts by mass of the polymerizable monomer.

Examples of the dispersion stabilizer include the following: organic fine particles (e.g., polystyrene fine particles, polymethyl methacrylate fine particles, polyacrylic acid fine particles, and polyepoxide fine particles), silica (e.g., colloidal silica), calcium carbonate, calcium phosphorate, aluminum hydroxide, barium carbonate, and magnesium hydroxide. The usage amount of the dispersion stabilizer is preferably from 0.01 part by mass to 20 parts by mass with respect to 100 parts by mass of the polymerizable monomer.

The suspension polymerization is preferably performed by using a pressure-resistant vessel under sealing. In addition, the raw materials for polymerization may be suspended with a disperser or the like, and then transferred into the pressure-resistant vessel and subjected to the suspension polymerization, or may be suspended in the pressure-resistant vessel. A polymerization temperature is preferably from 50° C. to 120° C. The polymerization, which may be performed at atmospheric pressure, is preferably performed under pressure (under a pressure higher than atmospheric pressure by from 0.1 MPa to 1 MPa) in order that the substance to be encapsulated in each of the thermally expandable microcapsules may not be vaporized. After the completion of the polymerization, solid-liquid separation and washing may be performed by centrifugation or filtration. When the solid-liquid separation and the washing are performed, drying or pulverization may be performed thereafter at a temperature equal to or less than the softening temperature of the resin forming each of the thermally expandable microcapsules. The drying and the pulverization may be performed by a known method, and a flash dryer, a fair-wind dryer, and a Nauta mixer may each be used. In addition, the drying and the pulverization may be simultaneously performed with a pulverization dryer. The surfactant and the dispersion stabilizer may be removed by repeating washing and filtration after the production of the microcapsules.

The Martens hardnesses of the insulating particles are not particularly limited, and are preferably smaller than the HMC of the core defined by the three-dimensional surface texture standards of the surface of the charging member.

The average of the Martens hardnesses of the insulating particles may be measured by the same method as that of the measurement of the HMC of the core. A hardness when an indenter is pushed into an insulating particle with a force of 0.04 mN is sampled from the results of measurement involving bringing the indenter into contact with the insulating particle with a microscope attached to a microhardness-measuring apparatus, and is defined as the Martens hardness of the insulating particle. The measurement is performed for 10 insulating particles, and the 10 measured values are averaged to calculate the average of the Martens hardnesses of the insulating particles. The particles at the time of the measurement of their Martens hardnesses may each be in the form of the raw material itself, or may each be in the form of being exposed in the surface layer of the charging member.

The volume-average particle diameter of the insulating particles is more preferably 6 μm or more and 45 μm or less. When the volume-average particle diameter is 6 μm or more, a horizontal streak-like image failure caused by intermittent occurrence of discharge in the downstream of the rotation direction of the electrophotographic photosensitive member resulting from insufficient discharge in the upstream thereof can be easily suppressed. In addition, when the volume-average particle diameter is 45 μm or less, image unevenness due to insufficient charging in sites each having a small surface roughness around the protruded portions can be easily prevented. The volume-average particle diameter is determined by the following method. A sectional image is photographed while a surface parallel to the surface of a projected portion in which the charging member is orthogonally projected on the surface of an electroconductive substrate is cut out with a cut surface focused ion beam processing apparatus (product name: FB-2000C, manufactured by Hitachi, Ltd.). Diameters and volumes when 50 insulating particles randomly selected based on the sectional image are approximated to spherical shapes are individually derived, and the volume-average particle diameter of the 50 insulating particles is calculated from these values.

In order to roughen the surface layer of the charging member, other particles may be incorporated into the rubber composition. A material for the other particles is not particularly limited, and for example, metal-based fine particles, such as aluminum, palladium, iron, copper, and silver, fibers, and metal oxides, such as titanium oxide, tin oxide, and zinc oxide, composite particles obtained by subjecting the surfaces of the metal-based fine particles, the fibers, and the metal oxides to surface treatments through an electrolytic treatment, spray coating, and mixing and shaking, and carbon particles, such as graphite and glassy carbon, may be used.

The shapes of the other particles are not particularly limited, and examples thereof include a spherical shape, an indefinite shape, a bowl shape, and a balloon shape.

The electroconductive elastic layer, which may be multilayered, is preferably a single layer from the viewpoints of a cost reduction and a reduction in environmental load by the simplification of a production process therefor. In addition, the thickness of the electroconductive elastic layer in this case falls within the range of preferably from 0.8 mm or more to 4.0 mm or less, particularly preferably from 1.2 mm or more to 3.0 mm or less in order that a nip width with the electrophotographic photosensitive member may be secured.

<Method of Producing Charging Member>

A method that is effective from the viewpoint that a production process is simple is described below as an example of a method of producing the charging member according to the present invention.

A method of producing a charging roller serving as the charging member according to the present invention includes the following three steps:

step 1: a step of preparing an unvulcanized rubber composition;

step 2: a step of supplying the electroconductive support and the unvulcanized rubber composition to a crosshead extrusion molding machine to provide an unvulcanized rubber roller; and step 3: a step of vulcanizing the unvulcanized rubber roller in air, followed by a surface treatment.

First, in the step 1, the unvulcanized rubber composition containing an electroconductive rubber composition forming the electroconductive elastic layer is prepared. When the surface layer of the charging member is roughened by the insulating particles, the content of the insulating particles in the unvulcanized rubber composition is preferably 5 parts by mass or more and 50 parts by mass or less with respect to 100 parts by mass of a raw material rubber. When the content is 5 parts by mass or more, the insulating particles can be easily caused to exist on the surface of the electroconductive elastic layer, and hence a potential gradient can be produced in a proper range of the surface of the electrophotographic photosensitive member. In addition, when the content is 50 parts by mass or less, the inhibition of toner movement due to a large amount of the insulating particles present on the surface of the electroconductive elastic layer can be easily suppressed. However, when the insulating particles are balloon-shaped particles, the content of the balloon-shaped particles in the rubber composition is preferably 2 parts by mass or more and 20 parts by mass or less with respect to 100 parts by mass of the raw material rubber. This is because the balloon-shaped particles have a specific gravity smaller than that of solid particles.

Next, in the step 2, the electroconductive support (mandrel) and the unvulcanized rubber composition are supplied to the crosshead extrusion molding machine, and are withdrawn to provide the unvulcanized rubber roller. The crosshead extrusion molding machine is such a molding machine that the unvulcanized rubber composition and the mandrel having a predetermined length are simultaneously fed into the machine, and the unvulcanized rubber roller obtained by uniformly coating the outer periphery of the mandrel with the unvulcanized rubber composition having a predetermined thickness is extruded from the outlet of a crosshead. The use of the crosshead extrusion molding machine can easily roughen the surface of the electroconductive elastic layer.

The entirety of the outer periphery of the mandrel is uniformly coated with the unvulcanized rubber composition by the crosshead extrusion molding machine, and hence the unvulcanized rubber roller having the mandrel placed at its center can be produced.

The crosshead extrusion molding machine includes: the crosshead into which the mandrel and the unvulcanized rubber composition are fed; a conveying roller configured to feed the mandrel into the crosshead; and a cylinder configured to feed the unvulcanized rubber composition into the crosshead.

The conveying roller can continuously feed a plurality of mandrels into the crosshead. The cylinder includes a screw in itself, and can feed the unvulcanized rubber composition into the crosshead through the rotation of the screw.

When the mandrel is fed into the crosshead, its entire periphery is coated with the unvulcanized rubber composition fed from the cylinder into the crosshead. Then, the mandrel is fed out from a die at the outlet of the crosshead as the unvulcanized rubber roller whose surface is coated with the unvulcanized rubber composition.

The unvulcanized rubber composition is preferably molded into a so-called crown shape in which an outer diameter (wall thickness) in a central portion in the longitudinal direction of each mandrel is larger than those in end portions in the direction. Thus, the unvulcanized rubber roller can be obtained.

Next, in the step 3, the unvulcanized rubber roller is vulcanized, and is then subjected to the surface treatment. The unvulcanized rubber roller is vulcanized under heating. Although specific examples of a method for the heating treatment may include hot-air furnace heating with a gear oven and heating with a far-infrared ray, the unvulcanized rubber roller is preferably vulcanized under a state in which its surface is in contact with air. Of those, the hot-air furnace heating is preferred because air can be intermittently supplied to the surface. When air is present during the vulcanization, the outermost surface of the rubber roller can be oxidized and cured, and hence the adhesiveness of the surface of the rubber roller can be reduced while the HMC of the core of the surface is kept at 2 $N/mm^2$ or more and 20 $N/mm^2$ or less. A vulcanized rubber composition in both end portions of the rubber roller is removed in a subsequent another step, and hence a vulcanized rubber roller is obtained. Therefore, in the resultant vulcanized rubber roller, both end portions of the mandrel are exposed.

Only the outermost surface is further oxidized and cured by subjecting the surface of the vulcanized rubber roller as it is to the surface treatment. As a result, the adhesiveness of the surface of the vulcanized rubber roller is further reduced, and hence the charging member according to the present invention can be obtained. A method for the surface treatment is preferably UV irradiation from the viewpoint that the production process is simple and the viewpoint that only the adhesiveness can be reduced without an increase in Martens hardness of the surface.

[Process Cartridge and Electrophotographic Apparatus]

A process cartridge of the present invention has a feature of integrally supporting the electrophotographic photosensitive member and the charging unit that have been described above, and at least one unit selected from the group consisting of a developing unit, a transferring unit, and a cleaning unit, and being removably mounted onto the main body of an electrophotographic apparatus.

In addition, an electrophotographic apparatus of the present invention has a feature of including the electrophotographic photosensitive member and the charging unit that have been described above, an exposing unit, and a developing unit.

An example of the schematic construction of an electrophotographic apparatus including a process cartridge including an electrophotographic photosensitive member is illustrated in FIG. 1.

In FIG. 1, an electrophotographic photosensitive member 1 having a cylindrical shape is rotationally driven about a shaft 2 in a direction indicated by the arrow at a predetermined peripheral speed. The surface (peripheral surface) of the electrophotographic photosensitive member 1 to be rotationally driven is uniformly charged to a predetermined positive or negative potential by a charging unit 3 (primary charging unit: a charging roller or the like). Next, the surface receives exposure light (image exposure light) 4 from an exposing unit (not shown), such as slit exposure or laser beam scanning exposure. Thus, electrostatic latent images corresponding to a target image are sequentially formed on the surface of the electrophotographic photosensitive member 1.

The electrostatic latent images formed on the surface of the electrophotographic photosensitive member 1 are then developed with toner in the developer of a developing unit 5 to form toner images on the electrophotographic photosensitive member 1. Next, the toner images on the surface of the electrophotographic photosensitive member 1 are sequentially transferred onto a transfer material P (e.g., paper) by a transfer bias from a transferring unit 6 (e.g., a transfer roller). The toner images on the surface of the electrophotographic photosensitive member 1 may be transferred onto the transfer material (e.g., paper) through an intermediate transfer member. The transfer material P is taken out of a transfer material-feeding unit (not shown) and fed into a space (abutting portion) between the electrophotographic photosensitive member 1 and the transferring unit 6 in synchronization with the rotation of the electrophotographic photosensitive member 1.

The transfer material P onto which the toner images have been transferred is separated from the surface of the electrophotographic photosensitive member 1 and introduced into a fixing unit 8 where the toner images are fixed. Thus, the transfer material is discharged as an image-formed product (a print or a copy) to the outside of the apparatus.

The transfer residual developer (toner) is removed from the surface of the electrophotographic photosensitive member 1 after the transfer of the toner images by a cleaning unit 7 (e.g., a cleaning blade). Next, the surface of the electrophotographic photosensitive member 1 is subjected to an electricity-removing treatment with pre-exposure light (not shown) from a pre-exposing unit (not shown), and is then repeatedly used in image formation. When the charging unit 3 is a contact charging unit, such as a charging roller, as illustrated in FIG. 1, the pre-exposure light is not necessarily required.

A plurality of constituents selected from the constituents, such as the electrophotographic photosensitive member 1, the charging unit 3, the developing unit 5, the transferring unit 6, and the cleaning unit 7, may be stored in a container and integrally bonded to form a process cartridge. Then, the process cartridge may be removably mounted onto the main body of an electrophotographic apparatus, such as a copying machine or a laser beam printer. In FIG. 1, the electrophotographic photosensitive member 1, the charging unit 3, the developing unit 5, and the cleaning unit 7 are integrally supported to provide a cartridge. Then, the cartridge is turned into a process cartridge 9 removably mounted onto the main body of the electrophotographic apparatus by using a guiding unit 10 of the main body of the electrophotographic apparatus, such as a rail.

EXAMPLES

The present invention is described in more detail below by way of Examples and Comparative Examples. The present invention is by no means limited to the following Examples, and various modifications may be made without departing from the gist of the present invention. In the description of the following Examples, "part(s)" is by mass unless otherwise specified. In each example, a charging roller was produced as a charging member.

Polyester Resin Production Example

<Polyester Resin (1)>

An acid halide solution was prepared by dissolving 29.5 g of a dicarboxylic acid halide represented by the following formula in dichloromethane.

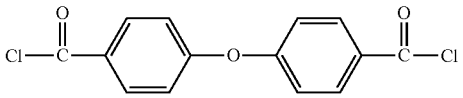

In addition, a diol compound solution was separately prepared by dissolving 24.4 g of a diol represented by the following formula in a 10% aqueous solution of sodium hydroxide, adding tributylbenzylammonium chloride as a polymerization catalyst to the solution, and stirring the mixture.

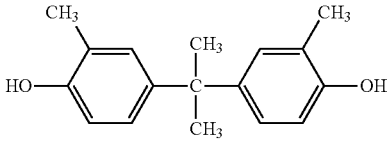

Next, polymerization was initiated by adding the acid halide solution to the diol compound solution while stirring. The polymerization was performed for 3 hours while a reaction temperature was kept at 25° C. or less and the mixture was stirred.

During the polymerization reaction, p-t-butylphenol was added as a polymerization modifier. After that, acetic acid was added to terminate the polymerization reaction, and washing with water was repeated until an aqueous phase became neutral.

After the washing, the dichloromethane solution was dropped to methanol under stirring to precipitate a polymer, and the polymer was vacuum-dried to provide a polyester resin (1).

<Polyester Resins (2) to (20)>

Production was performed in the same manner as in the polyester resin (1) except that in Polyester Resin Production Example, the kinds and amounts of the dicarboxylic acid halide and the diol to be used were changed. The structures and molar ratios of the produced polyester resins are shown in Table 1.

TABLE 1

| Resin | Structures each represented by general formula (I) and their ratio (molar ratio) | Structures each represented by general formula (II) and their ratio (molar ratio) |
|---|---|---|
| Polyester resin (1) | (I-1) | (II-1) |
| Polyester resin (2) | (I-1) | (II-2) |
| Polyester resin (3) | (I-1) | (II-3) |
| Polyester resin (4) | (I-1) | (II-2)/(II-3) = 50/50 |
| Polyester resin (5) | (I-1) | (II-1)/(II-2) = 50/50 |

TABLE 1-continued

| Resin | Structures each represented by general formula (I) and their ratio (molar ratio) | Structures each represented by general formula (II) and their ratio (molar ratio) |
|---|---|---|
| Polyester resin (6) | (I-1)/(I-2) = 70/30 | (II-2)/(II-3) = 50/50 |
| Polyester resin (7) | (I-1)/(I-2) = 50/50 | (II-2)/(II-3) = 50/50 |
| Polyester resin (8) | (I-5)/(I-2) = 50/50 | (II-1)/(II-2) = 70/30 |
| Polyester resin (9) | (I-5)/(I-2) = 65/35 | (II-1)/(II-2) = 70/30 |
| Polyester resin (10) | (I-5)/(I-2) = 65/35 | (II-1)/(II-2) = 50/50 |
| Polyester resin (11) | (I-5)/(I-2) = 70/30 | (II-1)/(II-2) = 70/30 |
| Polyester resin (12) | (I-8)/(I-2) = 65/35 | (II-1)/(II-2) = 70/30 |
| Polyester resin (13) | (I-7)/(I-2) = 65/35 | (II-1)/(II-2) = 70/30 |
| Polyester resin (14) | (I-6)/(I-2) = 65/35 | (II-1)/(II-2) = 70/30 |
| Polyester resin (15) | (I-9)/(I-2) = 65/35 | (II-1)/(II-2) = 70/30 |
| Polyester resin (16) | (I-9)/(I-3) = 65/35 | (II-1)/(II-2) = 70/30 |
| Polyester resin (17) | (I-5)/(I-3) = 65/35 | (II-1)/(II-2) = 70/30 |
| Polyester resin (18) | (I-5)/(I-4) = 65/35 | (II-1)/(II-2) = 70/30 |
| Polyester resin (19) | (I-9)/(I-2) = 65/35 | (II-2)/(II-3) = 50/50 |
| Polyester resin (20) | (I-9)/(I-4) = 65/35 | (II-2)/(II-3) = 50/50 |

Polycarbonate Resin Production Example

<Polycarbonate Resin (1)>

16.9 Grams of a diol represented by the following formula:

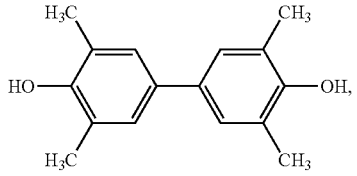

35.1 g of a diol represented by the following formula:

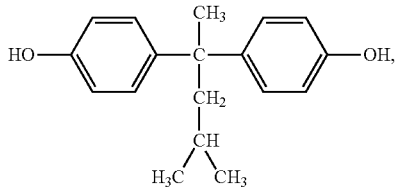

and 0.1 g of hydrosulfite were dissolved in 1,100 ml of a 5 mass % aqueous solution of sodium hydroxide. 500 Milliliters of methylene chloride was added to the solution. Next, while the mixture was stirred and its temperature was kept at 15° C., 60.0 g of phosgene was blown into the mixture over 60 minutes.

After the completion of the phosgene blowing, 1.0 g of p-t-butylphenol was added as a molecular weight modifier to the reaction liquid, followed by stirring to emulsify the reaction liquid. After the emulsification, 0.3 ml of triethylamine was added to the emulsified product, and the mixture was stirred at 23° C. for 1 hour to be polymerized.

After the completion of the polymerization, the reaction liquid was separated into an aqueous phase and an organic phase. The organic phase was neutralized with phosphoric acid, and water washing was repeated until the electroconductivity of the washed liquid (aqueous phase) became 10 μS/cm or less. The resultant polymer solution was dropped to warm water kept at 45° C., and the solvent was removed by evaporation. Thus, a white powdery precipitate was obtained. The resultant precipitate was filtered, and was dried at 110° C. for 24 hours to provide a polycarbonate resin (1). The resultant polycarbonate resin (1) was a polycarbonate resin having 35 mol % of the structure represented by the formula (III-1-1) and 65 mol % of the structure represented by the formula (III-2-1) as structures each represented by the formula (III).

<Polycarbonate Resins (2) to (10)>

Production was performed in the same manner as in the polycarbonate resin (1) except that in Polycarbonate Resin Production Example, the kinds and amounts of the diols to be used were changed. The structures and molar ratios of the produced polycarbonate resins are shown in Table 2.

TABLE 2

| Resin | Structures each represented by general formula (III) and their ratio (molar ratio) |
|---|---|
| Polycarbonate resin (1) | (III-1-1)/(III-2-1) = 35/65 |
| Polycarbonate resin (2) | (III-1-1)/(III-2-1) = 30/70 |
| Polycarbonate resin (3) | (III-1-1)/(III-2-4) = 35/65 |
| Polycarbonate resin (4) | (III-1-1)/(III-2-3) = 35/65 |
| Polycarbonate resin (5) | (III-1-1)/(III-2-2) = 35/65 |
| Polycarbonate resin (6) | (III-1-1)/(III-2-5) = 35/65 |
| Polycarbonate resin (7) | (III-1-2)/(III-2-5) = 35/65 |
| Polycarbonate resin (8) | (III-1-3)/(III-2-5) = 35/65 |
| Polycarbonate resin (9) | (III-1-2)/(III-2-1) = 35/65 |
| Polycarbonate resin (10) | (III-1-3)/(III-2-1) = 35/65 |

Electrophotographic Photosensitive Member Production Example

<Electrophotographic Photosensitive Member (1)>

An aluminum cylinder having a diameter of 24 mm and a length of 257 mm was used as a support (electroconductive support).

[Electroconductive Layer]

Next, 100 parts of zinc oxide particles (specific surface area: 15 $m^2/g$, average particle diameter: 70 nm, powder resistivity: $3.7\times10^5$ Ω·cm) were mixed with 500 parts of toluene under stirring.

1.5 Parts of N-(2-aminoethyl)-3-aminopropyltrimethoxysilane (product name: KBM-603, manufactured by Shin-Etsu Chemical Co., Ltd.) serving as a silane coupling agent was added to the mixture, and the whole was stirred for 6 hours.

After that, toluene was evaporated under reduced pressure, and the residue was heated at 140° C. for 6 hours to be dried. Thus, zinc oxide particles surface-treated with the silane coupling agent were obtained.

Next, 15 parts of a butyral resin (product name: BM-1, manufactured by Sekisui Chemical Co., Ltd.) serving as a polyol resin and 15 parts of a blocked isocyanate (product name: DESMODUR BL3175/1, manufactured by Sumika Bayer Urethane Co., Ltd.) were dissolved in a mixed solvent containing 73.5 parts of methyl ethyl ketone and 73.5 parts of 1-butanol.

81 Parts of the zinc oxide particles surface-treated with the silane coupling agent, 0.8 part of 2,3,4-trihydroxybenzophenone (manufactured by Tokyo Chemical Industry Co., Ltd.), and 0.81 part of zinc octylate (product name: NIKKA OCTHIX ZINC Zn 8%, manufactured by Nihon Kagaku Sangyo Co., Ltd.) were added to the solution. The mixture was loaded into a sand mill using glass beads each having a diameter of 0.8 mm, and was subjected to a dispersion treatment under an atmosphere at 23±3° C. for 3 hours.

After the dispersion treatment, 0.01 part of a silicone oil (product name: SH28PA, manufactured by Dow Corning Toray Silicone Co., Ltd.) and 5.6 parts of silicone resin particles (product name: TOSPEARL 145, manufactured by GE Toshiba Silicone) were added to the treated product, and the mixture was stirred to prepare a coating liquid for an electroconductive layer.

The coating liquid for an electroconductive layer was applied onto the support by dip coating, and the resultant coat was dried for 30 minutes at 150° C. to be thermally cured. Thus, an electroconductive layer having a thickness of 30 μm was formed.

[Undercoat Layer]

Next, 8.5 parts of a compound represented by the following formula serving as a charge-transporting substance, 15 parts of a blocked isocyanate compound (product name: SBN-70D, manufactured by Asahi Kasei Chemicals Corporation), 0.97 part of a polyvinyl alcohol resin (product name: KS-5Z, manufactured by Sekisui Chemical Co., Ltd.) serving as a resin, and 0.15 part of zinc(II) hexanoate (product name: ZINC(II) HEXANOATE, manufactured by Mitsuwa Chemicals Co., Ltd.) serving as a catalyst were dissolved in a mixed solvent containing 88 parts of 1-methoxy-2-propanol and 88 parts of tetrahydrofuran.

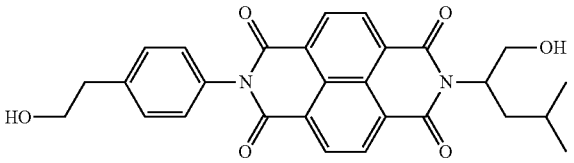

1.8 Parts of a silica slurry dispersed in isopropyl alcohol and having an average primary particle diameter of from 9 nm to 15 nm (product name: IPA-ST-UP, manufactured by Nissan Chemical Corporation, solid content concentration: 15 mass %, adhesiveness: 9 mPa·s) was passed through a nylon screen mesh sheet manufactured by Tokyo Screen Co., Ltd. (product name: N-No. 150T) and added to the solution, and the mixture was stirred for 1 hour. After that, the mixture was filtered with a filter manufactured by Advantec (product name: PF020) under pressure to prepare a coating liquid for an undercoat layer.

The coating liquid for an undercoat layer was applied onto the electroconductive layer by dip coating, and the resultant coat was heated for 20 minutes at 170° C. to be cured (polymerized). Thus, an undercoat layer having a thickness of 0.7 μm was formed on the electroconductive layer.

[Charge-Generating Layer]

Next, 2 parts of polyvinyl butyral (product name: S-LEC BX-1, manufactured by Sekisui Chemical Co., Ltd.) was dissolved in 100 parts of cyclohexanone.

4 Parts of a hydroxygallium phthalocyanine crystal (charge-generating substance) of a crystal form having strong peaks at Bragg angles 2θ±0.2° in CuKα characteristic X-ray diffraction of 7.4° and 28.1° was added to the solution.

The mixture was loaded into a sand mill using glass beads each having a diameter of 1 mm, and was subjected to a dispersion treatment under an atmosphere at 23±3° C. for 1 hour. After the dispersion treatment, 100 parts of ethyl acetate was added to the treated product. Thus, a coating liquid for a charge-generating layer was prepared.

The coating liquid for a charge-generating layer was applied onto the undercoat layer by dip coating, and the resultant coat was dried for 10 minutes at 90° C. to form a charge-generating layer having a thickness of 0.20 μm.

[Charge-Transporting Layer]

Next, 7.2 parts of the compound represented by the formula (CTM-1), 0.8 part of the compound represented by the formula (CTM-2), and 10 parts of the polyester resin (1) synthesized in Polyester Resin Production Example were dissolved in a mixed solution containing 33 parts of dimethoxymethane, 15 parts of orthoxylene, and 25 parts of methyl benzoate. Thus, a coating liquid for a charge-transporting layer was prepared.

The coating liquid for a charge-transporting layer was applied onto the charge-generating layer by dip coating to form a coat, and the resultant coat was dried at 130° C. for 30 minutes to form a charge-transporting layer (surface layer) having a thickness of 22 μm.

Thus, an electrophotographic photosensitive member (1) including the support, the electroconductive layer, the undercoat layer, the charge-generating layer, and the charge-transporting layer in the stated order was produced.

(Evaluation 1) Martens Hardness of Surface Layer of Electrophotographic Photosensitive Member The HMD of the surface layer of the electrophotographic photosensitive member was measured by the approach described in the foregoing. The HMD of the surface layer of the electrophotographic photosensitive member (1) was 274 $N/mm^2$.

<Electrophotographic Photosensitive Members (2) to (30)>

Production was performed in the same manner as in the electrophotographic photosensitive member (1) except that the kind of the polyester resin or the polycarbonate resin was changed as shown in Table 3. Details about the produced electrophotographic photosensitive members and the results of the evaluation thereof are shown in Table 3.

<Electrophotographic Photosensitive Member (31)>

An electrophotographic photosensitive member (31) including a support, an electroconductive layer, an undercoat layer, a charge-generating layer, and a charge-transporting layer in the stated order was produced by the same procedure as that of the electrophotographic photosensitive member (1) except that the method of producing the charge-transporting layer was changed as described below. Details about the produced electrophotographic photosensitive member and the result of the evaluation thereof are shown in Table 3.

[Charge-Transporting Layer]

0.1 Part of silica particles (product name: RX50, manufactured by Nippon Aerosil Co., Ltd.) were added to a solution of 9.9 parts of cyclopentanone, and were dispersed therein with an ultrasonic disperser over 2 hours. Thus, 10 parts of a silica-dispersed liquid was obtained.

7.2 Parts of the compound represented by the formula (CTM-1), 0.8 part of the compound represented by the formula (CTM-3), and 10 parts of the polyester resin (2) synthesized in Polyester Resin Production Example were dissolved in a mixed solution containing 40 parts of dimethoxymethane and 50 parts of cyclopentanone, and then 10 parts of the silica-dispersed liquid was added to the solution. Thus, a coating liquid for a charge-transporting layer was prepared.

The coating liquid for a charge-transporting layer was applied onto the charge-generating layer by dip coating to form a coat, and the resultant coat was dried at 130° C. for 30 minutes to form a charge-transporting layer (surface layer) having a thickness of 22 μm.

<Electrophotographic Photosensitive Members (32) to (43)>

Production was performed in the same manner as in the electrophotographic photosensitive member (31) except that the kind of the polyester resin or the polycarbonate resin, and the kind, volume-average particle diameter, and number of parts of the silica particles were changed as shown in Table 3. Details about the produced electrophotographic photosensitive members and the results of the evaluation thereof are shown in Table 3.

TABLE 3

| | Production condition for charge-transporting layer | | | | Result of (Evaluation 1) |
|---|---|---|---|---|---|
| Electrophotographic photosensitive member No. | Kind of resin | Kind of silica particles | Volume-average particle diameter (nm) | Mass ratio of silica particles to resin (%) | Martens hardness HMD ($N/mm^2$) |
| Electrophotographic photosensitive member (1) | Polyester resin (1) | — | — | — | 274 |
| Electrophotographic photosensitive member (2) | Polyester resin (2) | — | — | — | 274 |
| Electrophotographic photosensitive member (3) | Polyester resin (3) | — | — | — | 274 |
| Electrophotographic photosensitive member (4) | Polyester resin (4) | — | — | — | 274 |
| Electrophotographic photosensitive member (5) | Polyester resin (5) | — | — | — | 273 |
| Electrophotographic photosensitive member (6) | Polyester resin (6) | — | — | — | 279 |
| Electrophotographic photosensitive member (7) | Polyester resin (7) | — | — | — | 277 |
| Electrophotographic photosensitive member (8) | Polyester resin (8) | — | — | — | 280 |
| Electrophotographic photosensitive member (9) | Polyester resin (9) | — | — | — | 278 |
| Electrophotographic photosensitive member (10) | Polyester resin (10) | — | — | — | 273 |
| Electrophotographic photosensitive member (11) | Polyester resin (11) | — | — | — | 260 |

TABLE 3-continued

| | Production condition for charge-transporting layer | | | | Result of (Evaluation 1) |
|---|---|---|---|---|---|
| Electrophotographic photosensitive member No. | Kind of resin | Kind of silica particles | Volume-average particle diameter (nm) | Mass ratio of silica particles to resin (%) | Martens hardness HMD ($N/mm^2$) |
| Electrophotographic photosensitive member (12) | Polyester resin (12) | — | — | — | 270 |
| Electrophotographic photosensitive member (13) | Polyester resin (13) | — | — | — | 260 |
| Electrophotographic photosensitive member (14) | Polyester resin (14) | — | — | — | 260 |
| Electrophotographic photosensitive member (15) | Polyester resin (15) | — | — | — | 255 |
| Electrophotographic photosensitive member (16) | Polyester resin (16) | — | — | — | 255 |
| Electrophotographic photosensitive member (17) | Polyester resin (17) | — | — | — | 273 |
| Electrophotographic photosensitive member (18) | Polyester resin (18) | — | — | — | 260 |
| Electrophotographic photosensitive member (19) | Polyester resin (19) | — | — | — | 250 |
| Electrophotographic photosensitive member (20) | Polyester resin (20) | — | — | — | 245 |
| Electrophotographic photosensitive member (21) | Polycarbonate resin (1) | — | — | — | 278 |
| Electrophotographic photosensitive member (22) | Polycarbonate resin (2) | — | — | — | 260 |
| Electrophotographic photosensitive member (23) | Polycarbonate resin (3) | — | — | — | 270 |
| Electrophotographic photosensitive member (24) | Polycarbonate resin (4) | — | — | — | 260 |
| Electrophotographic photosensitive member (25) | Polycarbonate resin (5) | — | — | — | 260 |
| Electrophotographic photosensitive member (26) | Polycarbonate resin (6) | — | — | — | 255 |
| Electrophotographic photosensitive member (27) | Polycarbonate resin (7) | — | — | — | 255 |
| Electrophotographic photosensitive member (28) | Polycarbonate resin (8) | — | — | — | 245 |
| Electrophotographic photosensitive member (29) | Polycarbonate resin (9) | — | — | — | 273 |
| Electrophotographic photosensitive member (30) | Polycarbonate resin (10) | — | — | — | 260 |
| Electrophotographic photosensitive member (31) | Polyester resin (4) | RX50 | 40 | 1 | 288 |
| Electrophotographic photosensitive member (32) | Polyester resin (4) | RX50 | 40 | 10 | 292 |
| Electrophotographic photosensitive member (33) | Polyester resin (4) | N2N | 200 | 1 | 288 |
| Electrophotographic photosensitive member (34) | Polyester resin (4) | N2N | 200 | 10 | 292 |
| Electrophotographic photosensitive member (35) | Polyester resin (8) | RX50 | 40 | 1 | 292 |

TABLE 3-continued

| Electrophotographic photosensitive member No. | Production condition for charge-transporting layer | | | | Result of (Evaluation 1) |
|---|---|---|---|---|---|
| | Kind of resin | Kind of silica particles | Volume-average particle diameter (nm) | Mass ratio of silica particles to resin (%) | Martens hardness HMD ($N/mm^2$) |
| Electrophotographic photosensitive member (36) | Polyester resin (8) | RX50 | 40 | 10 | 298 |
| Electrophotographic photosensitive member (37) | Polyester resin (8) | N2N | 200 | 1 | 292 |
| Electrophotographic photosensitive member (38) | Polyester resin (8) | N2N | 200 | 10 | 298 |
| Electrophotographic photosensitive member (39) | Polyester resin (13) | RX50 | 40 | 1 | 280 |
| Electrophotographic photosensitive member (40) | Polycarbonate resin (1) | RX50 | 40 | 1 | 292 |
| Electrophotographic photosensitive member (41) | Polycarbonate resin (1) | RX50 | 40 | 10 | 298 |
| Electrophotographic photosensitive member (42) | Polycarbonate resin (1) | N2N | 200 | 1 | 292 |
| Electrophotographic photosensitive member (43) | Polycarbonate resin (1) | N2N | 200 | 10 | 298 |

The silica particles used in Table 3 are described.

RX50: Fumed silica surface-treated with a trimethylsilyl group (product name: RX50, manufactured by Nippon Aerosil Co., Ltd.)

N2N: Wet silica that is not subjected to any surface treatment (product name: N2N, manufactured by Ube Exsymo Co., Ltd.)

Charging Member Production Example

<Charging Member (1)>

1. Electroconductive Substrate

A thermosetting resin into which 10 mass % of carbon black had been incorporated was applied to the outer periphery of a cylindrical substrate made of stainless steel, the substrate having a diameter of 6 mm and a length of 252.5 mm, and was dried. The resultant was used as an electroconductive substrate.

2. Preparation of Unvulcanized Rubber Composition for Electroconductive Elastic Layer 50 Parts by mass of carbon black (product name: TOKABLACK #73605B, manufactured by Tokai Carbon Co., Ltd.), 5 parts by mass of zinc oxide (product name: ZINC WHITE TYPE 2, manufactured by Sakai Chemical Industry Co., Ltd.), 40 parts by mass of calcium carbonate (product name: SUPER #1700, manufactured by Maruo Calcium Co., Ltd.), and 1 part by mass of zinc stearate were added to 100 parts by mass of an acrylonitrile-butadiene rubber (product name: N230SL, manufactured by JSR Corporation), and the mixture was kneaded with a closed mixer regulated to 50° C. for 15 minutes. Next, 25 parts by mass of PMMA particles (product name: GANZPEARL GM0801, manufactured by Aica Kogyo Co., Ltd.), 1.5 parts by mass of sulfur, and 4 parts by mass of tetrabenzylthiuram disulfide (TBzTD) (product name: NOCCELER TBzTD, manufactured by Ouchi Shinko Chemical Industrial Co., Ltd.) were added to the mixture, and the whole was kneaded with a twin roll machine cooled to a temperature of 25° C. for 10 minutes to provide an unvulcanized rubber composition.

3. Molding of Vulcanized Rubber Roller

A coating layer of the unvulcanized rubber composition was formed on the outer periphery of the electroconductive substrate with a crosshead extrusion molding machine at a molding temperature of 100° C. and a screw revolution number of 9 rpm by operating the machine while changing the feeding speed of the electroconductive substrate. An unvulcanized rubber roller was of a crown shape having an outer diameter at a center in its axial direction of 8.60 mm and an outer diameter at a position distant from the center toward each of both of its ends by 90 mm of 8.50 mm.

After that, an unvulcanized rubber layer was heated with an electric hot-air furnace under an air atmosphere having a temperature of 160° C. for 1 hour to be vulcanized, and both end portions of the vulcanized rubber layer were cut so that its length in the axial direction became 232 mm. Thus, a vulcanized rubber roller was obtained.

4. Surface Treatment of Electroconductive Elastic Layer

The vulcanized rubber roller was subjected to a surface treatment by being irradiated with UV light having a wavelength of 254 nm so that an integrated light quantity became 9,000 $mJ/cm^2$. A low-pressure mercury lamp [manufactured by Harison Toshiba Lighting Corporation] was used in the UV irradiation. A charging member (1) was thus obtained, and was subjected to the following respective evaluations.

(Evaluation 2) Calculation of Averages of Martens Hardnesses of Core and Protruding Peaks of Surface of Charging Member The HMC of the surface of the charging member and the average of the Martens hardnesses of the protruding peaks of the surface were measured by the approach described in the foregoing. The HMC of the surface of the charging member (1) was 11.5 $N/mm^2$, and the average of the Martens hardnesses of the protruding peaks of the surface of the charging member (1) was 13.7 $N/mm^2$.

(Evaluation 3) Adhesiveness of Surface of Charging Member

The Vc of the surface of the charging member was measured by the approach described in the foregoing. The Vc of the surface of the charging member (1) was 59.9 mV.

(Evaluation 4) Method of Measuring Volume Resistivity of Insulating Particles Added to Charging Member The volume resistivity of the insulating particles is measured by the approach described in the foregoing. The volume resistivity of the insulating particles used in the charging member (1) was $10^{10}$ Ω·cm or more. With regard to the electroconductive characteristics of insulating particles, a case in which their volume resistivity is $10^{10}$ Ω·cm or more is represented as "insulative", and a case in which the volume resistivity is $10^3$ Ω·cm or less is represented as "electroconductive".

(Evaluation 5) Observation of Insulating Particles on Surface of Charging Member The insulating particles on the surface of the charging roller were observed with a confocal microscope (product name: OPTELICS HYBRID, manufactured by Lasertec Corporation). The observation was performed under the conditions of an objective lens magnification of 50, a pixel number of 1,024 pixels, and a height resolution of 0.1 The insulating particles were present in an exposed state.

(Evaluation 6) Observation of Shapes of Insulating Particles Added to Charging Member Whether or not the shapes of the insulating particles were balloon shapes was judged by observing the void amounts of the particles with a sectional image obtained while performing the cutting-out with the cut surface focused ion beam processing apparatus (product name: FB-2000C, manufactured by Hitachi, Ltd.) described in the foregoing. The insulating particles of Example 1 did not show balloon shapes. When 80% or more of the sectional areas of the insulating particles were voids, the particles were judged to be of balloon shapes. The subsequent Examples and Comparative Examples were also judged by the same criterion.

<Charging Member (2)>

Production was performed in the same manner as in the charging member (1) except that: the PMMA particles were changed to 3 parts by mass of thermally expandable microcapsule particles; and the shape of the unvulcanized rubber roller was changed to a crown shape having an outer diameter at a center in its axial direction of 8.25 mm and an outer diameter at a position distant from the center toward each of both of its ends by 90 mm of 8.15 mm. Details about the produced charging member and the results of the evaluations thereof are shown in Table 4.

A production example of the thermally expandable microcapsule particles (hereinafter referred to as "capsule particles") is described below. In addition, a commercial high-purity reagent was used as a material unless otherwise stated.

An aqueous mixed liquid containing 4,000 parts by mass of ion-exchanged water, 9 parts by mass of colloidal silica serving as a dispersion stabilizer, and 0.15 part by mass of polyvinyl pyrrolidone was prepared. Next, an oily mixed liquid formed of 50 parts by mass of acrylonitrile, 45 parts by mass of methacrylonitrile, and 5 parts by mass of methyl methacrylate serving as polymerizable monomers, 5.0 parts by mass of isopentane and 7.5 parts by mass of normal hexane serving as encapsulated substances, and 0.75 part by mass of dicumyl peroxide serving as a polymerization initiator was prepared. The oily mixed liquid was added to the aqueous mixed liquid, and 0.4 part by mass of sodium hydroxide was further added to the mixture. Thus, a dispersion was prepared.

Contents in the resultant dispersion were stirred and mixed with a homogenizer for 3 minutes. The dispersion was loaded into a polymerization reaction vessel purged with nitrogen, and was subjected to a reaction at 60° C. for 20 hours under stirring at 200 rpm to prepare a reaction product. The resultant reaction product was repeatedly filtered and washed with water, and was then dried at 80° C. for 5 hours to produce capsule particles.

The resultant capsule particles were classified with a dry air-flow classifier (product name: CLASSIEL N-20, manufactured by Seishin Enterprise Co., Ltd.) to provide capsule particles. The classification was performed under the condition of a number of revolutions of a classifying rotor of 1,500 rpm. The volume-average particle diameter of the resultant capsule particles was 10.0 μm.

<Charging Members (3) to (13)>

Production was performed in the same manner as in the charging member (1) except that the kinds and blending amounts of the materials for the surface of the charging member, the vulcanization conditions, and the surface treatment conditions were changed as shown in Table 4. Details about the produced charging members and the results of the evaluations thereof are shown in Table 4.

<Charging Member (14)>

A charging member (14) was produced in the same manner as in the charging member (1) except that: the unvulcanized rubber roller was molded into a shape having an outer diameter at a center in its axial direction of 9.00 mm and an outer diameter at a position distant from the center toward each of both of its ends by 90 mm of 8.90 mm; and the surface of the vulcanized rubber roller was polished with a plunge cut-type cylindrical polishing machine, and was then irradiated with UV light. The charging member was evaluated in the same manner as in the charging member (1). The polishing was performed as described below. A vitrified grindstone was used as a polishing grindstone, and abrasive grains were green silicon carbide (GC) and each had a particle size of 100 mesh. The number of revolutions of the roller was set to 400 rpm, and the number of revolutions of the polishing grindstone was set to 2,500 rpm. An infeed rate was set to 20 mm/min, and a spark-out time (time at an infeed of 0 mm) was set to 1 second. A polishing margin of 400 μm was left on the outer diameter of the vulcanized rubber roller, and the polishing was performed so that a difference in outer diameter between the center and the position distant from the center toward each of both the ends by 90 mm became 100 μm.

Details about the produced charging member and the results of the evaluations thereof are shown in Table 4.

TABLE 4

| | | Charging member (1) | Charging member (2) | Charging member (3) | Charging member (4) | Charging member (5) | Charging member (6) | Charging member (7) | Charging member (8) | Charging member (9) | Charging member (10) | Charging member (11) | Charging member (12) | Charging member (13) | Charging member (14) |
|---|---|---|---|---|---|---|---|---|---|---|---|---|---|---|---|
| Surface forming material | NBR (JSR N230SL, JSR Corporation) | 100 | 100 | 100 | 100 | 100 | 100 | 100 | 100 | 100 | 100 | 100 | 100 | — | 100 |
| | Hydrin rubber ("EPION 301", Osaka Soda Co., Ltd.) | — | — | — | — | — | — | — | — | — | — | — | — | 100 | — |
| | Carbon black | 50 | 50 | 50 | 50 | 50 | 50 | 50 | 50 | 50 | 50 | 50 | 50 | 50 | 50 |
| | Zinc oxide | 5 | 5 | 5 | 5 | 5 | 5 | 5 | 5 | 5 | 5 | 5 | 5 | 5 | 5 |
| | Zinc stearate | 1 | 1 | 1 | 1 | 1 | 1 | 1 | 1 | 1 | 1 | 1 | 1 | 1 | 1 |
| | Calcium carbonate | 40 | 40 | 40 | 40 | 40 | 40 | 40 | 40 | 40 | 40 | 40 | 40 | 40 | 40 |
| | Sulfur | 1.5 | 1.5 | 1.5 | 1.5 | 1.5 | 2 | 0.4 | 2.5 | 0.5 | 2.5 | 0.2 | 1.5 | 1.5 | 1.5 |
| | NOCCELER TBzTD | 4 | 4 | 4 | 4 | 4 | 4 | 4 | 2 | 2.5 | 5 | 3.5 | 4 | 4 | 4 |
| | PMMA particles (GANZPEARL GM0801, Aica Kogyo Co., Ltd.) | 25 | — | — | — | — | 25 | 25 | 25 | 25 | 25 | 25 | 25 | 25 | 25 |
| | Polyurethane particles (DAIMICBEAZ UCN-8150CM, Dainichiseika Color & Chemicals Mfg. Co., Ltd.) | — | — | 25 | — | — | — | — | — | — | — | — | — | — | — |
| | Capsule particles | — | 3 | — | — | — | — | — | — | — | — | — | — | — | — |
| | Carbon particles (GLASSY CARBON, Tokai Carbon Co., Ltd.) | — | — | — | 25 | — | — | — | — | — | — | — | — | — | — |
| Vulcanization condition | At 145° C. for 1 hour | — | — | — | — | — | — | — | — | • | — | • | — | — | — |
| | At 160° C. for 1 hour | • | • | • | • | • | — | • | — | — | — | — | • | • | • |
| | At 175° C. for 1 hour | — | — | — | — | — | — | — | • | — | — | — | — | — | — |
| | At 185° C. for 1 hour | — | — | — | — | — | • | — | — | — | — | — | — | — | — |
| | At 210° C. for 1 hour | — | — | — | — | — | — | — | — | — | • | — | — | — | — |
| Surface treatment condition | UV irradiation, integrated light quantity: 9,000 mJ/cm$^2$ | • | • | • | • | • | • | • | — | — | • | • | — | • | • |
| | UV irradiation, integrated light quantity: 2,500 mJ/cm$^2$ | — | — | — | — | — | — | — | • | • | — | — | — | — | — |
| | Polishing treatment | — | — | — | — | — | — | — | — | — | — | — | — | — | • |
| Evaluation result | Martens hardness [N/mm$^2$] Core | 11.5 | 9.5 | 10.6 | 11.7 | 10.4 | 20.0 | 2.0 | 20.0 | 2.0 | 28.2 | 1.7 | 11.4 | 5.5 | 11.4 |
| | Martens hardness [N/mm$^2$] Protruding peaks | 13.7 | 5.8 | 7.5 | 13.9 | 10.4 | 22.0 | 4.1 | 22.0 | 4.2 | 30.2 | 3.7 | 13.4 | 7.6 | 13.4 |
| | Adhesiveness [mV] | 59.9 | 59.9 | 59.9 | 59.9 | 59.9 | 59.1 | 61.5 | 70.0 | 70.0 | 57.6 | 63.4 | 75.5 | 72.9 | 73.5 |
| | Electroconductivity of particles | Insulative | Insulative | Insulative | Electro-conductive | — | Insulative | Insulative | Insulative | Insulative | Insulative | Insulative | Insulative | Insulative | Insulative |
| | Exposure of particles in surface layer | Present | Present | Present | Present | — | Present | Present | Present | Present | Present | Present | Present | Present | Present |
| | Balloon shape | Absent | Present | Present | Absent | — | Absent | Absent | Absent | Absent | Absent | Absent | Absent | Absent | Absent |

Example 1

The following evaluation was performed by using the electrophotographic photosensitive member (1) and the charging member (1) produced in accordance with Electrophotographic Photosensitive Member Production Example and Charging Member Production Example described above.

(Evaluation 7) Evaluation of Charging Potential after Endurance

The produced charging member and electrophotographic photosensitive member were mounted on a reconstructed machine of a laser beam printer manufactured by Hewlett-Packard Company (product name: HP LaserJet Enterprise Color M553dn, manufactured by HP Japan Inc.) under an environment having a temperature of 23° C. and a humidity of 50% RH. Then, the surface potential of the photosensitive member was measured. Details about the measurement are as described below.

The surface potential was measured as described below. A process cartridge of the laser beam printer was reconstructed, and a potential probe (product name: MODEL 6000B-8, manufactured by Trek Japan) was mounted at its development position, followed by the measurement of a potential in the central portion of the electrophotographic photosensitive member with a surface potentiometer (product name: MODEL 344, manufactured by Trek Japan). The surface potential of the electrophotographic photosensitive member was set so that its initial charging potential (Vd) became −500 V.

A character image having a print percentage of 1% was output on 3,000 sheets of A4 size plain paper with the laser beam printer.

A difference between the charging potentials of the photosensitive member before and after the formation of the 3,000 images was measured. As a value for the fluctuation in charging potential becomes smaller, a suppressing effect on the fluctuation in charging potential at the time of long-term use of the process cartridge becomes higher. The difference in charging potential was evaluated by a difference between the charging potential after the endurance (Vdt) and the initial charging potential (Vd) based on the following equation.

$$\Delta Vd = |\text{charging potential after endurance } (Vdt) - \text{initial charging potential } (Vd)|$$

The result is shown in Table 5.

Examples 2 to 67 and Comparative Examples 1 to 5

The evaluations were performed in the same manner as in Example 1 except that the combination of the charging member and the electrophotographic photosensitive member was changed as shown in Table 5. The results are shown in Table 5.

TABLE 5

| Example No. | Electrophotographic photosensitive member No. | (Evaluation 1) HMD ($N/mm^2$) | Charging member No. | (Evaluation 2) Core HMC ($N/mm^2$) | (Evaluation 3) Vc (mV) | (Evaluation 7) ΔVd (V) |
|---|---|---|---|---|---|---|
| Example 1 | Electrophotographic photosensitive member (1) | 274 | Charging member (2) | 9.5 | 59.9 | 8 |
| Example 2 | Electrophotographic photosensitive member (2) | 274 | Charging member (2) | 9.5 | 59.9 | 8 |
| Example 3 | Electrophotographic photosensitive member (3) | 274 | Charging member (2) | 9.5 | 59.9 | 8 |
| Example 4 | Electrophotographic photosensitive member (4) | 274 | Charging member (1) | 11.5 | 59.9 | 11 |
| Example 5 | Electrophotographic photosensitive member (4) | 274 | Charging member (2) | 9.5 | 59.9 | 8 |
| Example 6 | Electrophotographic photosensitive member (4) | 274 | Charging member (3) | 10.6 | 59.9 | 10 |
| Example 7 | Electrophotographic photosensitive member (4) | 274 | Charging member (4) | 11.7 | 59.9 | 12 |
| Example 8 | Electrophotographic photosensitive member (4) | 274 | Charging member (5) | 10.4 | 59.9 | 13 |
| Example 9 | Electrophotographic photosensitive member (4) | 274 | Charging member (6) | 20.0 | 59.1 | 15 |
| Example 10 | Electrophotographic photosensitive member (4) | 274 | Charging member (7) | 2.0 | 61.5 | 16 |
| Example 11 | Electrophotographic photosensitive member (4) | 274 | Charging member (8) | 20.0 | 70.0 | 17 |
| Example 12 | Electrophotographic photosensitive member (4) | 274 | Charging member (9) | 2.0 | 70.0 | 18 |
| Example 13 | Electrophotographic photosensitive member (5) | 273 | Charging member (2) | 9.5 | 59.9 | 8 |

TABLE 5-continued

| Example No. | Electrophotographic photosensitive member No. | (Evaluation 1) HMD ($N/mm^2$) | Charging member No. | (Evaluation 2) Core HMC ($N/mm^2$) | (Evaluation 3) Vc (mV) | (Evaluation 7) ΔVd (V) |
|---|---|---|---|---|---|---|
| Example 14 | Electrophotographic photosensitive member (6) | 279 | Charging member (2) | 9.5 | 59.9 | 7 |
| Example 15 | Electrophotographic photosensitive member (7) | 277 | Charging member (2) | 9.5 | 59.9 | 7 |
| Example 16 | Electrophotographic photosensitive member (8) | 280 | Charging member (1) | 11.5 | 59.9 | 9 |
| Example 17 | Electrophotographic photosensitive member (8) | 280 | Charging member (2) | 9.5 | 59.9 | 7 |
| Example 18 | Electrophotographic photosensitive member (8) | 280 | Charging member (3) | 10.6 | 59.9 | 8 |
| Example 19 | Electrophotographic photosensitive member (8) | 280 | Charging member (4) | 11.7 | 59.9 | 10 |
| Example 20 | Electrophotographic photosensitive member (8) | 280 | Charging member (5) | 10.4 | 59.9 | 12 |
| Example 21 | Electrophotographic photosensitive member (8) | 280 | Charging member (6) | 20.0 | 59.1 | 14 |
| Example 22 | Electrophotographic photosensitive member (8) | 280 | Charging member (7) | 2.0 | 61.5 | 15 |
| Example 23 | Electrophotographic photosensitive member (8) | 280 | Charging member (8) | 20.0 | 70.0 | 16 |
| Example 24 | Electrophotographic photosensitive member (8) | 280 | Charging member (9) | 2.0 | 70.0 | 17 |
| Example 25 | Electrophotographic photosensitive member (9) | 278 | Charging member (2) | 9.5 | 59.9 | 7 |
| Example 26 | Electrophotographic photosensitive member (10) | 273 | Charging member (2) | 9.5 | 59.9 | 8 |
| Example 27 | Electrophotographic photosensitive member (11) | 260 | Charging member (2) | 9.5 | 59.9 | 11 |
| Example 28 | Electrophotographic photosensitive member (12) | 270 | Charging member (2) | 9.5 | 59.9 | 9 |
| Example 29 | Electrophotographic photosensitive member (13) | 260 | Charging member (2) | 9.5 | 59.9 | 11 |
| Example 30 | Electrophotographic photosensitive member (14) | 260 | Charging member (2) | 9.5 | 59.9 | 11 |
| Example 31 | Electrophotographic photosensitive member (15) | 255 | Charging member (2) | 9.5 | 59.9 | 12 |
| Example 32 | Electrophotographic photosensitive member (16) | 255 | Charging member (2) | 9.5 | 59.9 | 12 |
| Example 33 | Electrophotographic photosensitive member (17) | 273 | Charging member (2) | 9.5 | 59.9 | 8 |
| Example 34 | Electrophotographic photosensitive member (18) | 260 | Charging member (2) | 9.5 | 59.9 | 11 |
| Example 35 | Electrophotographic photosensitive member (19) | 250 | Charging member (2) | 9.5 | 59.9 | 14 |
| Example 36 | Electrophotographic photosensitive member (20) | 245 | Charging member (2) | 9.5 | 59.9 | 14 |
| Example 37 | Electrophotographic photosensitive member (21) | 278 | Charging member (2) | 9.5 | 59.9 | 7 |
| Example 38 | Electrophotographic photosensitive member (22) | 260 | Charging member (2) | 9.5 | 59.9 | 11 |

TABLE 5-continued

| Example No. | Electrophotographic photosensitive member No. | (Evaluation 1) HMD ($N/mm^2$) | Charging member No. | (Evaluation 2) Core HMC ($N/mm^2$) | (Evaluation 3) Vc (mV) | (Evaluation 7) ΔVd (V) |
|---|---|---|---|---|---|---|
| Example 39 | Electrophotographic photosensitive member (23) | 270 | Charging member (2) | 9.5 | 59.9 | 9 |
| Example 40 | Electrophotographic photosensitive member (24) | 260 | Charging member (2) | 9.5 | 59.9 | 11 |
| Example 41 | Electrophotographic photosensitive member (25) | 260 | Charging member (2) | 9.5 | 59.9 | 11 |
| Example 42 | Electrophotographic photosensitive member (26) | 255 | Charging member (2) | 9.5 | 59.9 | 12 |
| Example 43 | Electrophotographic photosensitive member (27) | 255 | Charging member (2) | 9.5 | 59.9 | 12 |
| Example 44 | Electrophotographic photosensitive member (28) | 245 | Charging member (2) | 9.5 | 59.9 | 14 |
| Example 45 | Electrophotographic photosensitive member (29) | 273 | Charging member (2) | 9.5 | 59.9 | 8 |
| Example 46 | Electrophotographic photosensitive member (30) | 260 | Charging member (2) | 9.5 | 59.9 | 11 |
| Example 47 | Electrophotographic photosensitive member (31) | 288 | Charging member (2) | 9.5 | 59.9 | 6 |
| Example 48 | Electrophotographic photosensitive member (32) | 292 | Charging member (2) | 9.5 | 59.9 | 4 |
| Example 49 | Electrophotographic photosensitive member (33) | 288 | Charging member (2) | 9.5 | 59.9 | 6 |
| Example 50 | Electrophotographic photosensitive member (34) | 292 | Charging member (2) | 9.5 | 59.9 | 4 |
| Example 51 | Electrophotographic photosensitive member (35) | 292 | Charging member (2) | 9.5 | 59.9 | 4 |
| Example 52 | Electrophotographic photosensitive member (36) | 298 | Charging member (2) | 9.5 | 59.9 | 2 |
| Example 53 | Electrophotographic photosensitive member (37) | 292 | Charging member (2) | 9.5 | 59.9 | 4 |
| Example 54 | Electrophotographic photosensitive member (38) | 298 | Charging member (2) | 9.5 | 59.9 | 2 |
| Example 55 | Electrophotographic photosensitive member (39) | 280 | Charging member (2) | 9.5 | 59.9 | 7 |
| Example 56 | Electrophotographic photosensitive member (40) | 292 | Charging member (2) | 9.5 | 59.9 | 4 |
| Example 57 | Electrophotographic photosensitive member (41) | 298 | Charging member (2) | 9.5 | 59.9 | 2 |
| Example 58 | Electrophotographic photosensitive member (42) | 292 | Charging member (2) | 9.5 | 59.9 | 4 |
| Example 59 | Electrophotographic photosensitive member (43) | 298 | Charging member (2) | 9.5 | 59.9 | 2 |
| Example 60 | Electrophotographic photosensitive member (19) | 250 | Charging member (8) | 20.0 | 70.0 | 18 |
| Example 61 | Electrophotographic photosensitive member (19) | 250 | Charging member (9) | 2.0 | 70.0 | 18 |
| Example 62 | Electrophotographic photosensitive member (20) | 245 | Charging member (8) | 20.0 | 70.0 | 19 |
| Example 63 | Electrophotographic photosensitive member (20) | 245 | Charging member (9) | 2.0 | 70.0 | 19 |

TABLE 5-continued

| Example No. | Electrophotographic photosensitive member No. | (Evaluation 1) HMD ($N/mm^2$) | Charging member No. | (Evaluation 2) Core HMC ($N/mm^2$) | (Evaluation 3) Vc (mV) | (Evaluation 7) ΔVd (V) |
|---|---|---|---|---|---|---|
| Example 64 | Electrophotographic photosensitive member (27) | 255 | Charging member (8) | 20.0 | 70.0 | 18 |
| Example 65 | Electrophotographic photosensitive member (27) | 255 | Charging member (9) | 2.0 | 70.0 | 19 |
| Example 66 | Electrophotographic photosensitive member (28) | 245 | Charging member (8) | 20.0 | 70.0 | 19 |
| Example 67 | Electrophotographic photosensitive member (28) | 245 | Charging member (9) | 2.0 | 70.0 | 19 |
| Comparative Example 1 | Electrophotographic photosensitive member (4) | 274 | Charging member (10) | 28.2 | 57.6 | 25 |
| Comparative Example 2 | Electrophotographic photosensitive member (4) | 274 | Charging member (11) | 1.7 | 63.4 | 30 |
| Comparative Example 3 | Electrophotographic photosensitive member (4) | 274 | Charging member (12) | 11.4 | 75.5 | 33 |
| Comparative Example 4 | Electrophotographic photosensitive member (4) | 274 | Charging member (13) | 5.5 | 72.9 | 31 |
| Comparative Example 5 | Electrophotographic photosensitive member (4) | 274 | Charging member (14) | 11.4 | 73.5 | 32 |

As shown in Comparative Examples 1 to 5, when an electrophotographic photosensitive member having an HMD of 245 $N/mm^2$ or more is combined with a charging member having an HMC of more than 20 $N/mm^2$, a charging member having an HMC of less than 2 $N/mm^2$, or a charging member having a Vc of more than 70 mV, a suppressing effect on a fluctuation in charging potential of the photosensitive member after its endurance is not sufficiently obtained. When an electrophotographic photosensitive member having an HMD of 245 $N/mm^2$ or more is combined with a charging member having an HMC of 2 $N/mm^2$ or more and 20 $N/mm^2$ or less, and a Vc of 70 mV or less, a suppressing effect on a fluctuation in charging potential of the photosensitive member after its endurance is obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-226332, filed Nov. 24, 2017, which is hereby incorporated by reference herein in its entirety.

What is claimed is:

1. A process cartridge comprising:

an electrophotographic photosensitive member having a surface layer containing a resin and a charge-transporting substance; and a charging member configured to charge the electrophotographic photosensitive member, wherein the surface layer has an average Martens hardness of 245 $N/mm^2$ or more measured at a pushing force of 7 mN, and a core defined by three-dimensional surface texture standards (ISO 25178-2:2012) of a surface of the charging member has an average Martens hardness of 2 to 20 $N/mm^2$ measured at a pushing force of 0.04 mN, and an average adhesiveness of 70 mV or less measured with a scanning probe microscope in a field of view of 2-micrometer square.

2. A process cartridge according to claim 1, wherein the resin comprises at least one member selected from the group consisting of formulae (I)-(III):

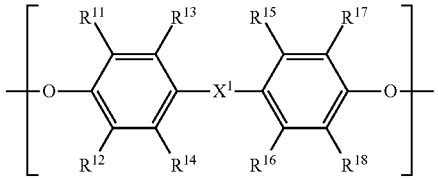

(I)

where $X^1$ represents a single bond, an alkylidene group, or a cycloalkylidene group, and $R^{11}$ to $R^{18}$ independently represent a hydrogen atom or an alkyl group;

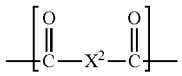

(II)

where $X^2$ represents a divalent group; and (III)

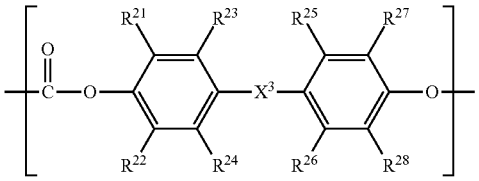

where $X^3$ represents a single bond, an oxygen atom, an alkylidene group, or a cycloalkylidene group, and $R^{21}$ to $R^{28}$ independently represent a hydrogen atom or an alkyl group.

3. A process cartridge according to claim 2, wherein the resin comprises formula (I) and formula (II), and the structure represented by formula (I) comprises at least one member selected from the group consisting of formulae (I-1)-(I-4):

(I-1)

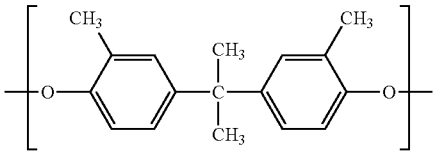

(I-2)

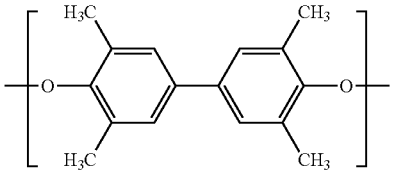

(I-3)

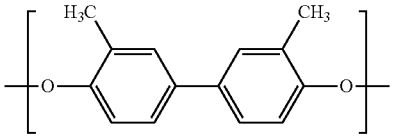

(I-4)

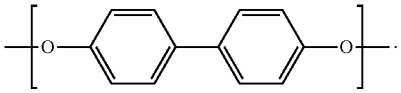

4. A process cartridge according to claim 2, wherein formula (II) comprises at least one member selected from the group consisting of formulae (II-1)-(II-3):

(II-1)

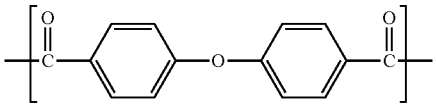

(II-2)

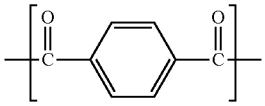

-continued (II-3)

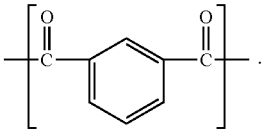

5. A process cartridge according to claim 2, wherein the resin comprises formula (III), and the structure represented by formula (III) comprises formula (III-1):

(III-1)

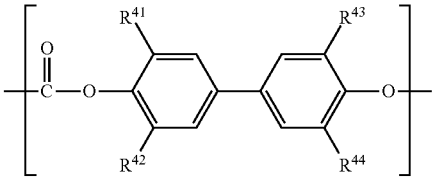

where $R^{41}$ to $R^{44}$ independently represent a hydrogen atom or a methyl group.

6. A process cartridge according to claim 5, wherein a ratio of formula (III-1) to formula (III) is 30 mol % or more.

7. A process cartridge according to claim 5, wherein the resin comprises at least one member selected from the group consisting of formulae (III-2-1)-(III-2-4):

(III-2-1)

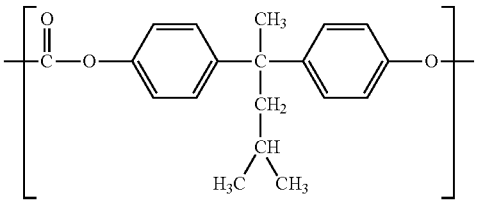

(III-2-2)

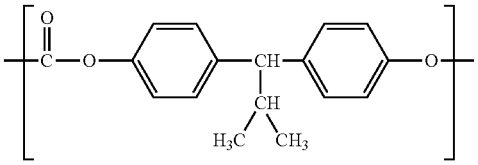

(III-2-3)

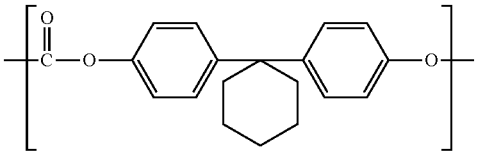

-continued (III-2-4)

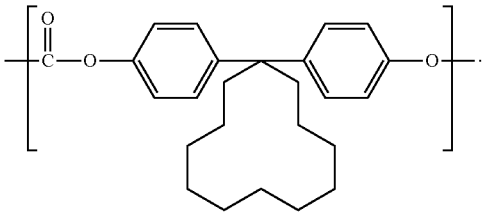

8. A process cartridge according to claim 1, wherein the surface layer of the electrophotographic photosensitive member contains silica particles having an average primary particle diameter of 40 to 200 nm, and a content of the silica particles is 1 to 10 mass % with respect to a solid content of the resin.

9. A process cartridge according to claim 1, wherein the surface of the charging member contains a vulcanizate of a rubber composition containing a polymer having a butadiene skeleton.

10. An electrophotographic apparatus, comprising a process cartridge and at least one of an exposing unit and a developing unit, said process cartridge comprising:

an electrophotographic photosensitive member having a surface layer containing a resin and a charge-transporting substance, and a charging member configured to charge the electrophotographic photosensitive member, wherein the surface layer has an average Martens hardness of 245 $N/mm^2$ or more measured at a pushing force of 7 mN, and a core defined by three-dimensional surface texture standards (ISO 25178-2:2012) of a surface of the charging member has an average Martens hardness of 2 to 20 $N/mm^2$ measured at a pushing force of 0.04 mN, and an average adhesiveness of 70 mV or less measured with a scanning probe microscope in a field of view of 2-micrometer square.

* * * * *